US010829960B2

(12) United States Patent
Denison et al.

(10) Patent No.: US 10,829,960 B2
(45) Date of Patent: Nov. 10, 2020

(54) COOLER LOCK

(71) Applicant: TriTeq Lock and Security, L.L.C., Elk Grove Village, IL (US)

(72) Inventors: William Denison, North Barrington, IL (US); Calin V. Roatis, Long Grove, IL (US)

(73) Assignee: TriTeq Lock and Security, L.L.C., Elk Grove Village, IL (US)

( * ) Notice: Subject to any disclaimer, the term of this patent is extended or adjusted under 35 U.S.C. 154(b) by 403 days.

(21) Appl. No.: 15/466,829

(22) Filed: Mar. 22, 2017

(65) Prior Publication Data

US 2017/0260775 A1 Sep. 14, 2017

Related U.S. Application Data

(63) Continuation-in-part of application No. 13/930,664, filed on Jun. 28, 2013.

(Continued)

(51) Int. Cl.

| | |
|---|---|
| ***E05B 47/00*** | (2006.01) |
| ***E05B 65/00*** | (2006.01) |
| ***E05B 47/06*** | (2006.01) |
| ***F25D 23/02*** | (2006.01) |
| ***E05B 65/08*** | (2006.01) |

(52) U.S. Cl.

CPC ..... *E05B 65/0046* (2013.01); *E05B 47/0603* (2013.01); *E05B 65/0811* (2013.01); *F25D 23/028* (2013.01); *E05B 2047/0024* (2013.01); *E05B 2047/0069* (2013.01); *Y10T 70/70* (2015.04); *Y10T 70/7006* (2015.04)

(58) Field of Classification Search

CPC . Y10T 70/5009; Y10T 70/40; Y10T 70/7062; Y10T 70/625; Y10T 70/7051; Y10T 70/7107; Y10T 70/402; Y10T 70/5004; Y10T 70/7559; Y10T 70/70; Y10T 70/7006; E05B 73/0082; E05B 73/0005; E05B 73/00; E05B 73/0017; E05B 47/0001; E05B 47/0012; E05B 47/00; E05B 47/0004; E05B 47/0603; E05B 65/0046; E05B 65/0811; E05B 2047/0024; E05B 2047/0069; F25D 23/028

USPC ... 70/267–271, 263, 275, 277, 281, 282, 14, 70/58, 63; 292/DIG. 21

See application file for complete search history.

(56) References Cited

U.S. PATENT DOCUMENTS 1,013,553 A * 1/1912 Johnson ..... E05C 19/028 292/16
3,583,737 A * 6/1971 Tutikawa ..... E05C 19/02 292/16

(Continued)

*Primary Examiner* — Suzanne L Barrett
(74) *Attorney, Agent, or Firm* — Charles T. Riggs, Jr.

(57) ABSTRACT

A cooler access control system locks a cooler when occurrence of an event is detected that requires limiting access to the inside of the cooler. Examples of such events include the loss of power to the cooler for a predetermined period of time, the opening of the cooler door for longer than an allowed time, the loss of functionality of a temperature probe and others. In an embodiment, a service mode is supported wherein the door is left unlocked despite the occurrence of such an event, to allow a stocker or other personnel to leave the cooler door open while stocking the cooler with product. Locking structures for both single door coolers and double door coolers are disclosed.

15 Claims, 25 Drawing Sheets

Related U.S. Application Data

(60) Provisional application No. 61/754,332, filed on Jan. 18, 2013.

(56) References Cited

U.S. PATENT DOCUMENTS 4,332,406 A * 6/1982 Ehrmann ..... E05C 7/06 292/18
4,457,146 A * 7/1984 Weinerman ..... E05B 65/0811 292/216
4,882,564 A * 11/1989 Monroe ..... B60H 1/00978 340/449
5,216,906 A * 6/1993 Kurrasch ..... E05B 15/0006 292/153
5,268,811 A * 12/1993 Maeda ..... G07C 9/00103 361/172
5,572,873 A * 11/1996 Lavigne ..... A61J 1/165 62/126
7,728,711 B2 * 6/2010 Shoenfeld ..... E05B 47/0012 340/5.1
8,063,735 B2 * 11/2011 Shoenfeld ..... A61B 50/10 340/5.73
8,742,889 B2 * 6/2014 Kaczmarz ..... G06Q 10/087 235/382
8,773,270 B2 * 7/2014 Paydar ..... G01K 3/04 340/585
9,388,613 B2 * 7/2016 Kamin ..... E05C 1/08
2006/0186678 A1 * 8/2006 Myers ..... E05B 17/0029 292/341.16
2009/0121500 A1 * 5/2009 Halliwell ..... E05B 15/021 292/341.15
2009/0132090 A1 * 5/2009 Kaczmarz ..... F25D 29/008 700/275
2009/0230699 A1 * 9/2009 Carabalona ..... B60R 7/06 292/48
2012/0011367 A1 * 1/2012 Denison ..... G07C 9/00571 713/170

* cited by examiner

COOLER LOCK

RELATED APPLICATIONS

This application relates to and claims priority to U.S. provisional patent application No. 61/754,332 entitled "Cooler Lock", filed on Jan. 18, 2013, and U.S. nonprovisional patent application Ser. No. 13/930,664 entitled "Cooler Lock", filed Jun. 28, 2013, the entire disclosures of which are incorporated herein by reference.

TECHNICAL FIELD

The exemplary teachings herein pertain generally to enclosure locking mechanisms, and more particularly, to an access control system that includes features for providing locking and access to a refrigerated cooler or freezer. The lock mechanism generally comprises a strike or other engagement element mounted on the door or cabinet, and a motor-controllable latch mounted on the other of the door or cabinet.

BACKGROUND

Locks for containers or enclosures, for the general purpose of safeguarding the contents of the containers or enclosures, come in many different forms. However, such traditional locks are inadequate or inapplicable for use on a refrigerated cooler or freezer, which usually is to remain in an unlocked state to allow access to the contents of the cooler or freezer, and only is to be locked in certain situations.

Therefore, a need exists for one or more methods, systems and devices which are directed towards selectively securing refrigerated coolers or freezers by locking the door or other closure device to the cooler upon detection of an event resulting in a change in temperature of the internal recess of the refrigerated cooler or freeze that requires looking the unlocked food storage cooler or freezer. Accordingly, to address the above stated issue(s) and other issue(s), the method(s), system(s) and device(s) disclosed herein fulfill this and other such needs.

SUMMARY

The exemplary technique(s), system(s), device(s) and method(s) presented herein relate to locks for coolers or freezers, in particular electronic locks for refrigerated coolers or freezers, and more specifically electronic locks for food storage refrigerated coolers or freezers such as reach-in food service vending coolers or freezers, or micro-market single or double door coolers and freezers. The locks can be attached to or integrated onto the cooler cabinet and/or a door or other closure device for the cooler to lock the door or other closure device to the cooler cabinet. The locks can be provided OEM (original equipment manufacturer) or can be retrofitted to an existing cooler or freezer and/or its door or closure device.

In one embodiment, a food storage cooler access control system for locking an unlocked food storage cooler or freezer is disclosed. The food storage cooler or freezer has a cooler body with walls forming art internal recess for storing food, and a single cooler door operatively connected to the cooler body, such that when the cooler door is closed to the cooler body the internal recess is isolated. A locking element is on one of the cooler body and the cooler door; and a locking mechanism is mounted to the other one of the cooler body and the cooler door. The locking mechanism is configured to selectively engage the locking element to lock and unlock the cooler door. The cooler access control system is configured to detect an event resulting in a change in temperature of the internal recess that requires locking the unlocked food storage cooler or freezer, and in response, to actuate the locking mechanism to lock the cooler door to the cooler body.

In another embodiment, a food storage cooler access control system for locking an unlocked food storage cooler or freezer is disclosed. The food storage cooler or freezer has a cooler body with walls forming an internal recess for storing food, and double cooler doors operatively connected to the cooler body, such that when the cooler doors are closed to the cooler body the internal recess is isolated. A locking element is oil each cooler door; and a locking mechanism is mounted to the cooler body. The locking mechanism is configured to selectively engage each locking element to lock and unlock the cooler doors. The cooler access control system is configured to detect an event resulting in a change in temperature of the internal recess that requires locking the unlocked food storage cooler or freezer, and in response, to actuate the locking mechanism to lock the cooler doors to the cooler body.

Additional objects, advantages and novel features will be set forth in part in the description which follows, and in part will become apparent to those skilled in the art upon examination of the following and the accompanying drawings or may be learned by production or operation of the examples.

BRIEF DESCRIPTION OF THE DRAWINGS

The drawing figures depict one or more implementations in accord with the present teachings, by way of example only, not by way of limitation. In the drawing figures, like reference numerals refer to the same or similar elements.

DETAILED DESCRIPTION

The following description refers to numerous specific details which are set forth by way of examples to provide a thorough understanding of the relevant teachings. It should be apparent to those skilled in the art that the present teachings may be practiced without such details. In other instances, well known methods, procedures, and components have been described at a relatively high-level, without detail, in order to avoid unnecessarily obscuring aspects of the present teachings.

A refrigerated cooler typically consists of a refrigerated cabinet to hold food and beverages and a glass door that swings outward via a hinge. Typically the door or the cabinet has a rubber gasket or other flexible sealing element (collectively "gasket") along the edge to create a harrier between the cold air inside the cabinet and the warm air outside the cabinet. The gasket further serves to accommodate misalignments between the cabinet and the door, when for example the cooler is placed on a floor that is not level such that the structure is twisted, or when over time the door droops downward from the hinge and fails to maintain alignment with the cabinet. Typically the inner surface of the door will interface to the outer surface of the cabinet, and as such the door usually does not reside on the interior of the cabinet. Typically the door is held to the edge surface of the cabinet by a magnet. In addition, typically the door is hung and the hinge is aligned such that the door is naturally biased to swing toward the cabinet without applying an external force to a surface of the door.

When the door is opened, e.g., by a consumer in order to retrieve product, and is then released, the door will naturally swing toward the closed position. As the door reaches the closed position from the open position, its movement is accelerating slightly and needs to be stopped. The gasket will serve to absorb some of the energy released by the door as it abruptly stops. The magnet serves to some extent to maintain the door in the closed position and the magnet and the gasket together also serve to minimize the amount of bounce the door may exhibit as it moves to a stopped position.

Figure 1A:
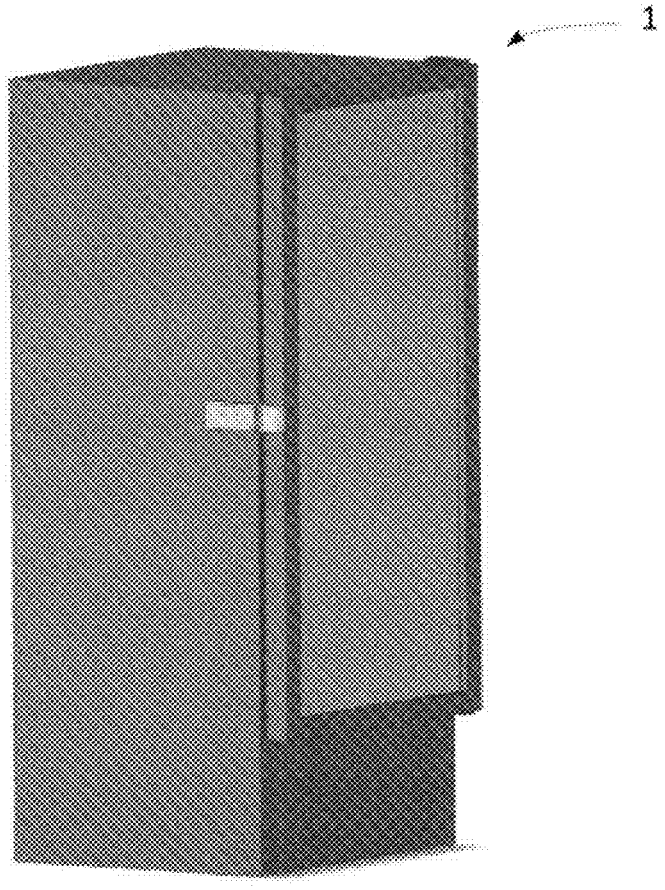
FIG. 1A is a simplified perspective view of a cooler structure within which aspects of the disclosure may be implemented.
Figure 1B:
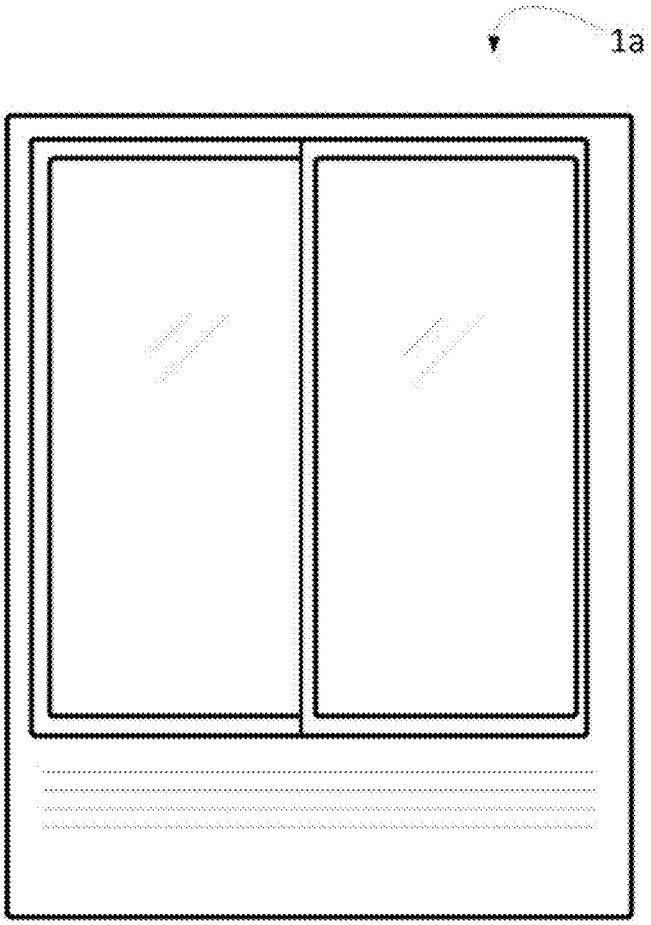
FIG. 1B is a simplified front view of an alternative cooler structure within which aspects of the disclosure may be implemented.
Figure 2:
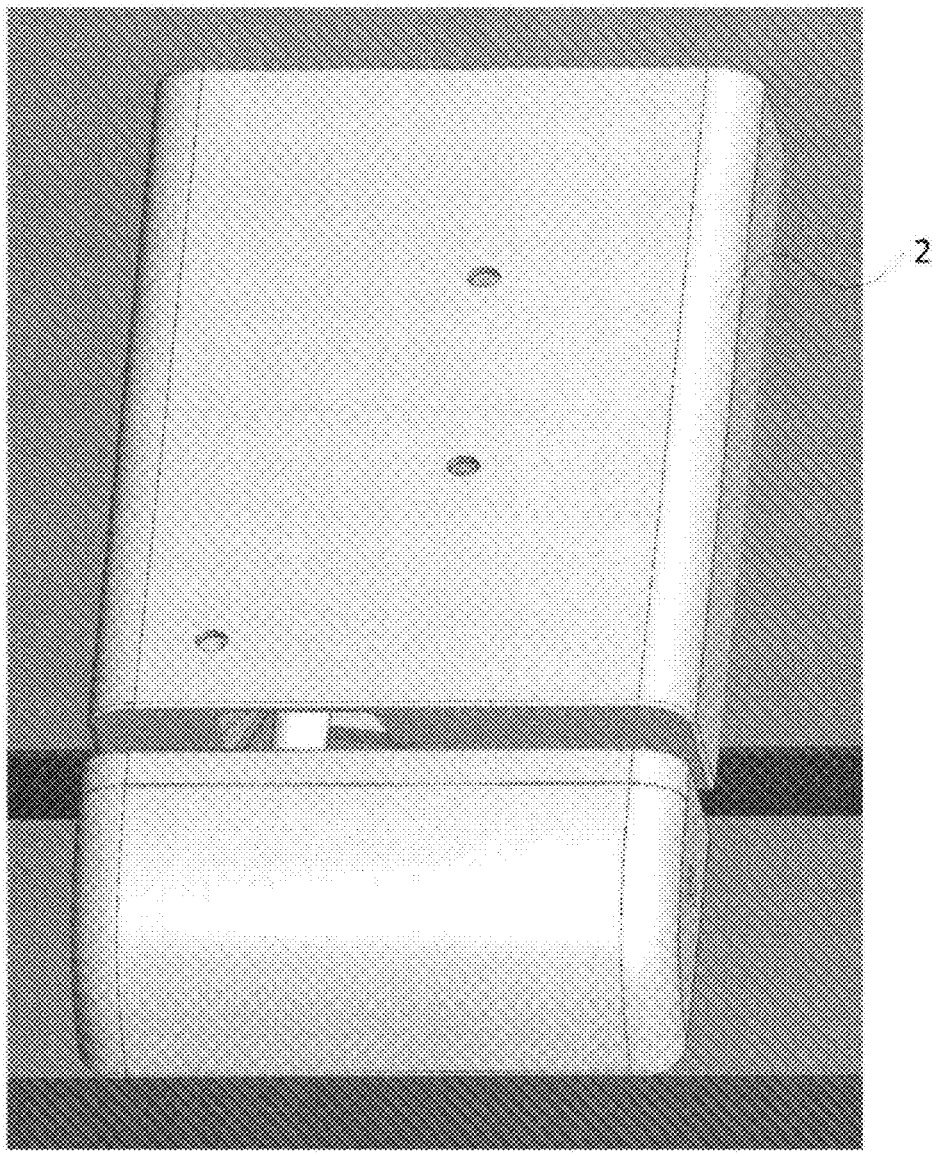
FIG. 2 is an enlarged perspective view of a cooler locking structure in accordance with an aspect of the disclosure.
Figure 3:
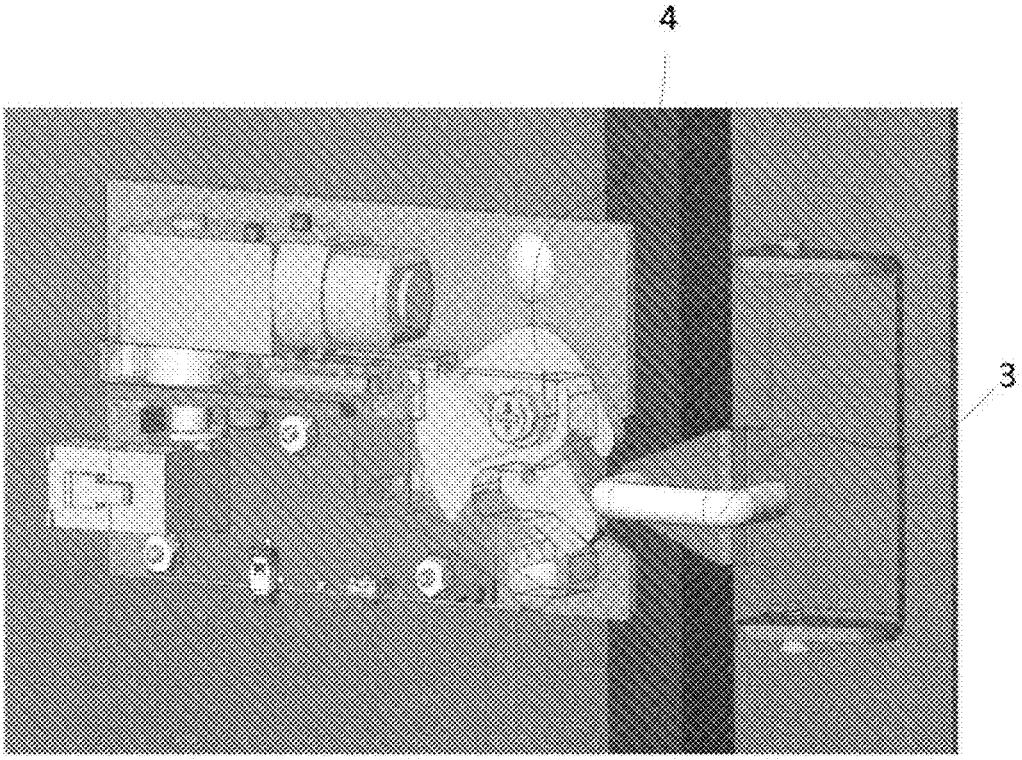
FIG. 3 is a simplified interior view of the cooler locking structure of FIG. 2 in accordance with an aspect of the disclosure.

FIG. 1A is a perspective view of a cooler 1 within, which embodiments of the invention may be implemented. FIGS. 2 and 3 illustrate the lock mechanism 2 mounted to the cooler 1, showing the lock 2 while the strike 3 is entering the latch 4. The mechanism may be mounted in a door centered position on the vertical edge of the door/cabinet as shown in FIG. 1, and it can be mounted at the top or bottom of the door/cabinet at the vertical edge or along either of the horizontal edges at the top or bottom of the door/cabinet in order to hide or protect the mechanism from the reach of customers. In an embodiment, shown, the lock mechanism is mounted to the cooler cabinet and the strike is mounted to the door. In alternative embodiments, the lock can be mounted to the door and the strike mounted to the cabinet. In another embodiment, the strike unit or function can be provided by the outside surface of the door, or a surface provided by a slot within either the door or the cabinet.

As noted above, in an embodiment, the lockable enclosure is a freezer. Moreover, whether a freezer or a cooler, enclosures having sliding rather than hinged doors may also benefit from application of the disclosed principles. Referring to FIG. 1B, typically such enclosures 1A include two doors mounted in tracks adjacent to but offset from one another, with one or both doors being slidable across the front of the cooler. In such coolers, each door may also include a gasket on one or both of the door and the cabinet, used to seal the door and cabinet together when the door is closed. The sliding doors are typically biased to slide back to the closed position in the event that the user does not properly slide the door to the closed position. For sliding door coolers, the lock can be applied to either the door or the cabinet of each door, or, a lock can be applied to one door and the strike can be applied to the other door, such that when the lock and strike are engaged, neither door can slide open or parallel to the other door.

Figure 4:
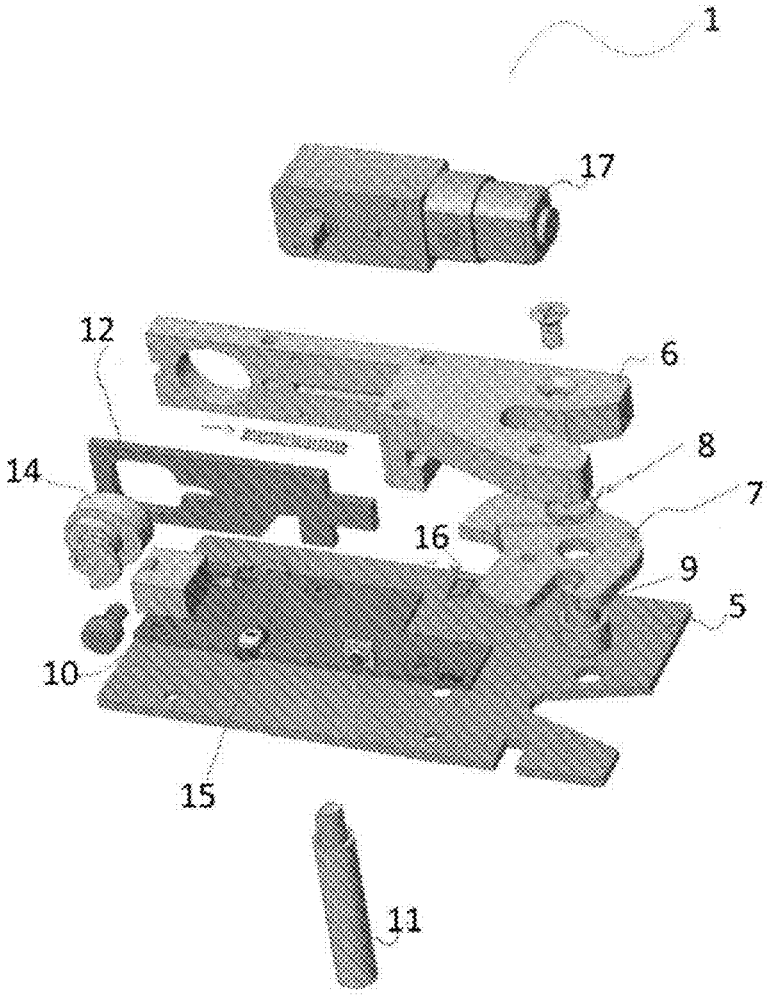
FIG. 4 is a simplified exploded view of the lock structure of FIG. 2 in accordance with an aspect of the disclosure.
Figure 5:
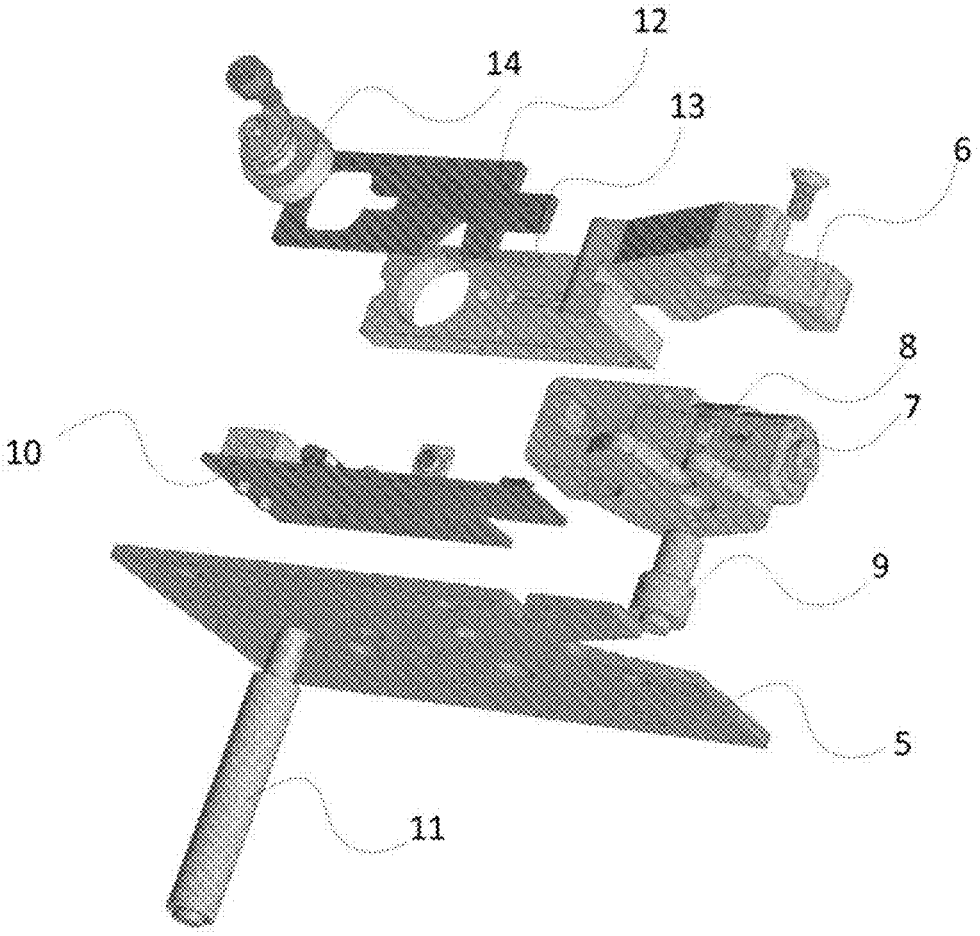
FIG. 5 is a further simplified exploded view of the lock structure of FIG. 2 in accordance with an aspect of the disclosure.
Figure 6:
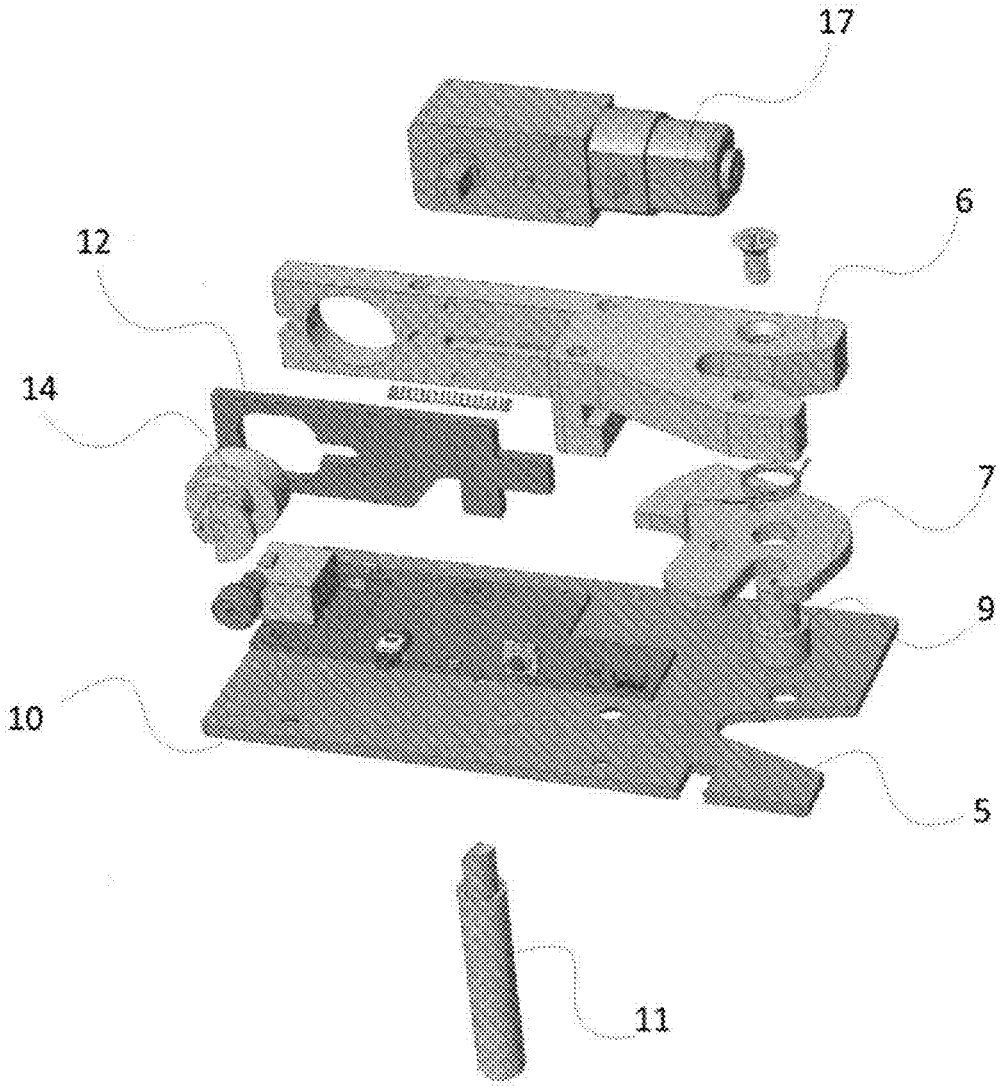
FIG. 6 is a further simplified exploded view of the lock structure of FIG. 2 in accordance with an aspect of the disclosure.
Figure 7:
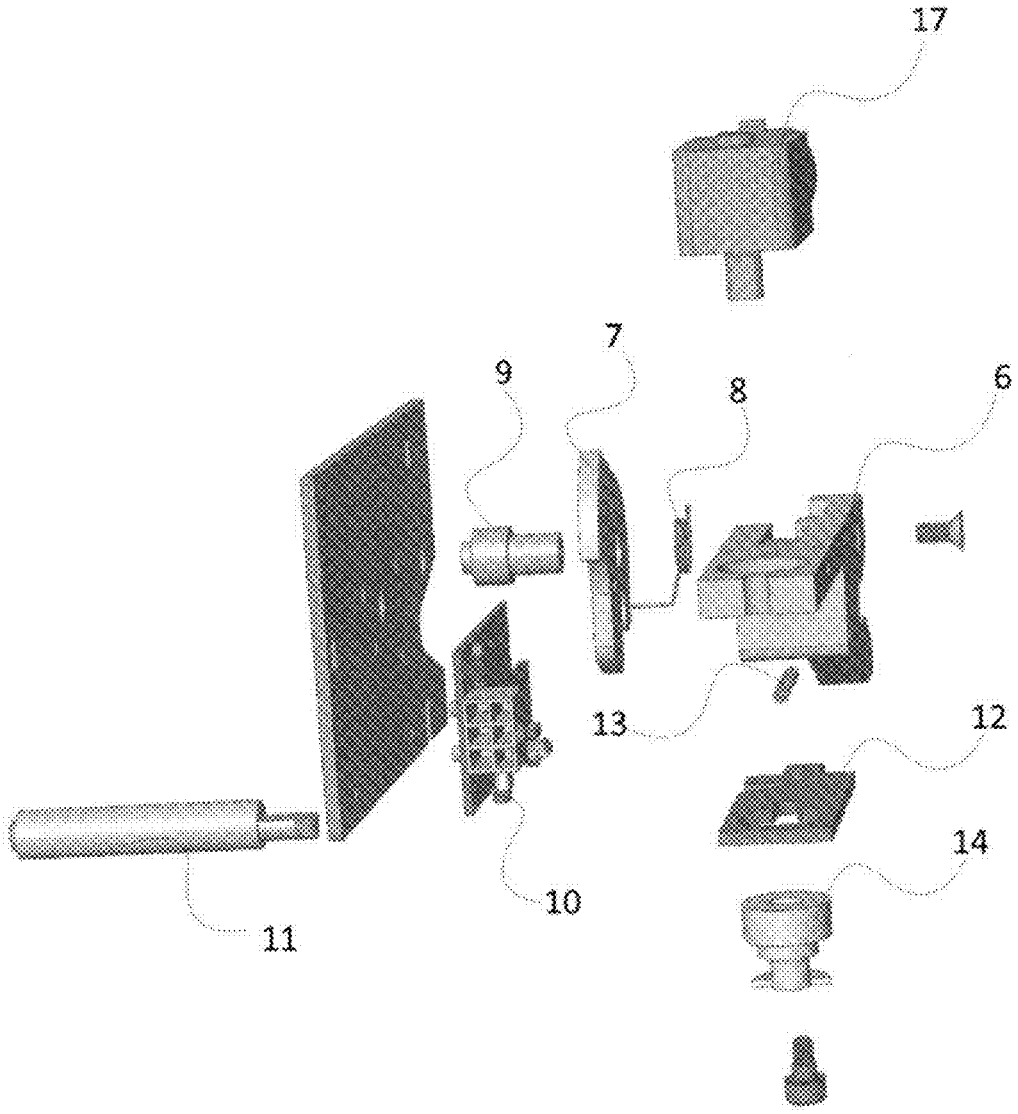
FIG. 7 is a further simplified exploded view of the lock structure of FIG. 2 in accordance with an aspect of the disclosure.

In any case, the lock mechanism consists of a number of components as labeled in FIG. 4 and as shown in different views in FIGS. 5-7. The components include the mounting base 5, latch base 6, claw 7, claw spring 8, shaft 9, circuit board 10, manual release push rod 11, slider 12, slider spring 13, cam 14, cam sensor 15, claw sensor 16, and motor 17. The components are primarily mounted to the latch base 6 and the mounting base 5, which are stationary. The latch base 6 has a "Y" shaped opening and serves to help guide the strike to connect to the claw 7 properly when the door is closed. The claw 7 rotates clock-wise and against the force of the claw spring 8 as the door is closed and it receives the strike. The force of the claw spring 8 is ideally light enough so the force of the door closing will overcome the claw spring force and the claw 7 will receive the strike and rotate clock-wise.

Figure 8:
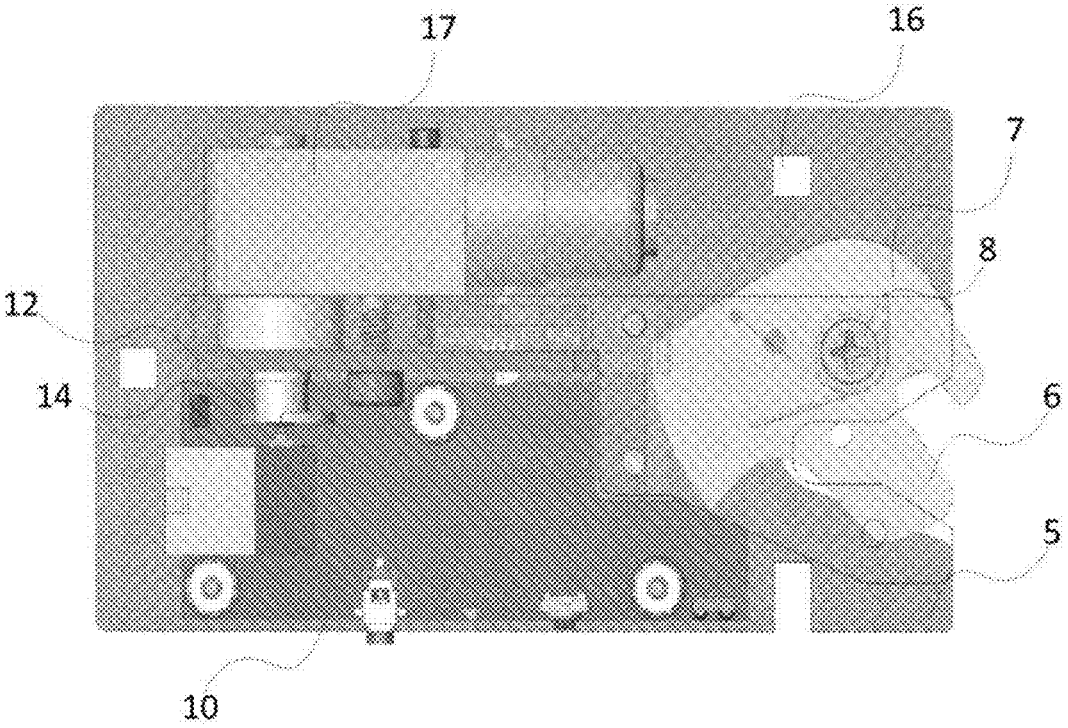
FIG. 8 is a further simplified interior view of the cooler locking structure of FIG. 2 in accordance with an aspect of the disclosure.
Figure 9:
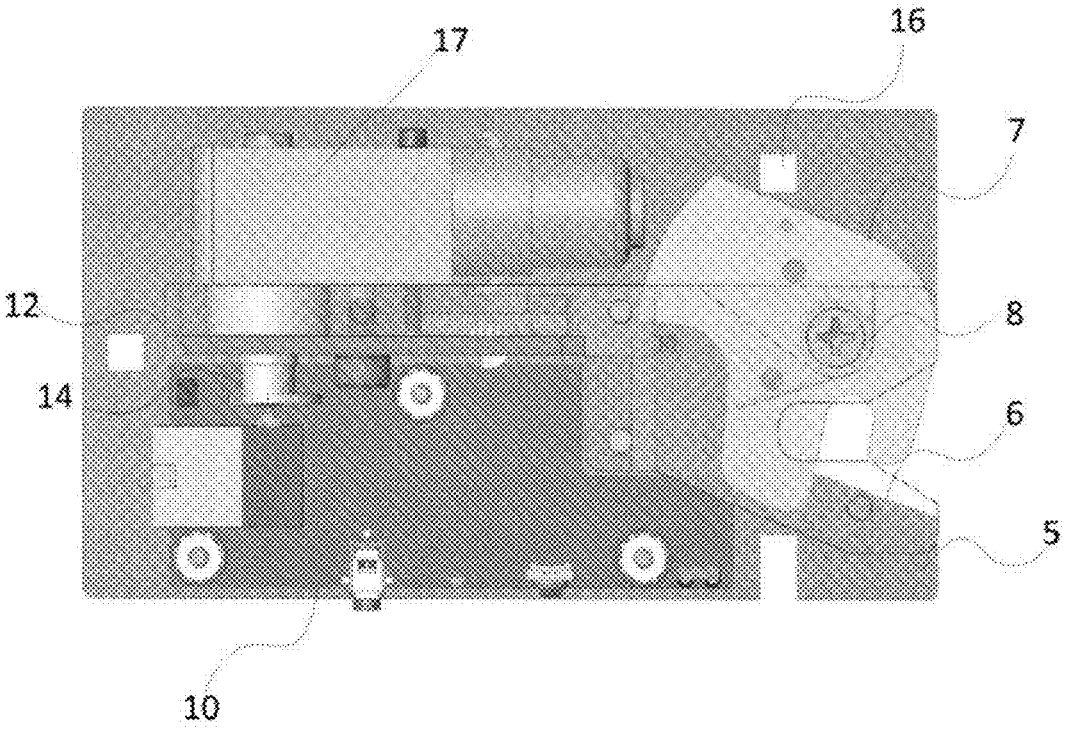
FIG. 9 is a further simplified interior view of the cooler locking structure of FIG. 2 in accordance with an aspect of the disclosure.

In the strike received position of FIG. 9, the claw sensor 17 will detect that the claw 7 has received the strike. The claw spring 8 is biased to push the claw 7 out so when the door is opened the claw 7 will rotate counter-clockwise to move to the receive position as in FIG. 8. This cycle whereby the claw 7 rotates clockwise to counterclockwise while the door moves from closed to open repeats over and over again as food or other material is being vended from the cooler, as shown in FIGS. 8 and 9.

Figure 10:
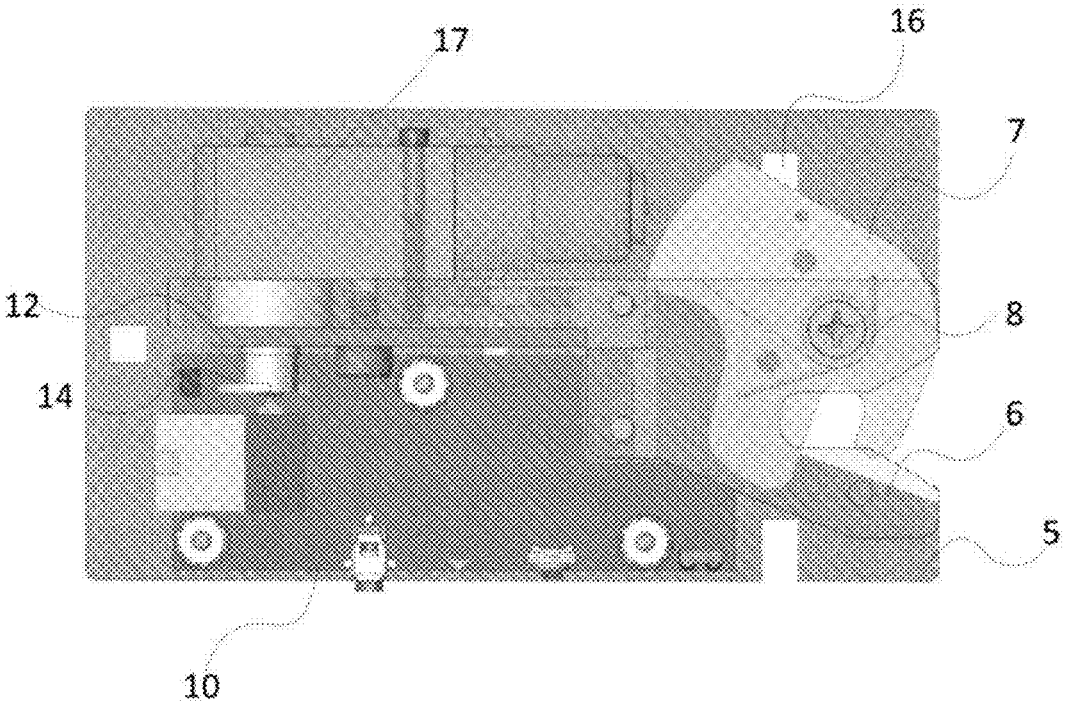
FIG. 10 is a further simplified interior view of the cooler locking structure of FIG. 2 in accordance with an aspect of the disclosure.

The slider 12 when extended to the right acts to lock the claw 7 holding the strike in the clockwise rotated position during certain conditions while the door is closed, as shown in FIG. 10. The slider 12 is biased to the locked extended position by the slider spring 13 when the door is intended to be locked. The cam 14 connected to the motor 17 will act to move the slider 12 via the inner surface of the slider 12 to the unlocked position upon being energized by the circuit board 10 as shown in FIG. 9. A cam sensor 16 on the circuit board 10 senses the position of the cam 14 to determine the slider 12 has moved to the required position.

Figure 11:
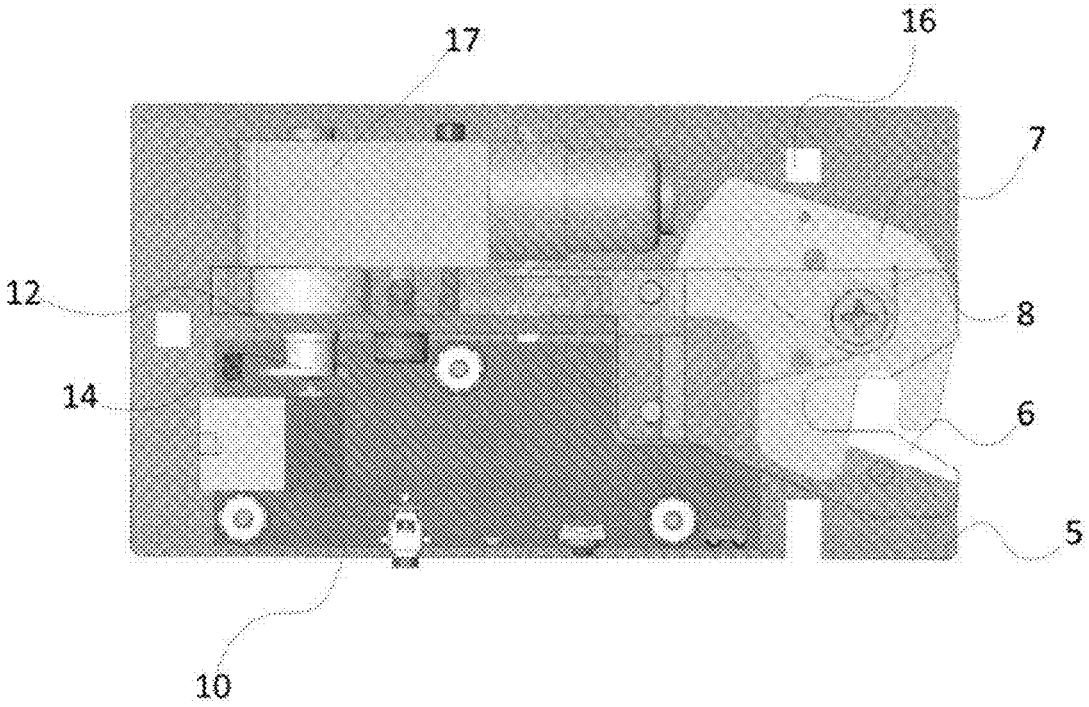
FIG. 11 is a further simplified interior view of the cooler locking structure of FIG. 2 in accordance with an aspect of the disclosure.
Figure 12:
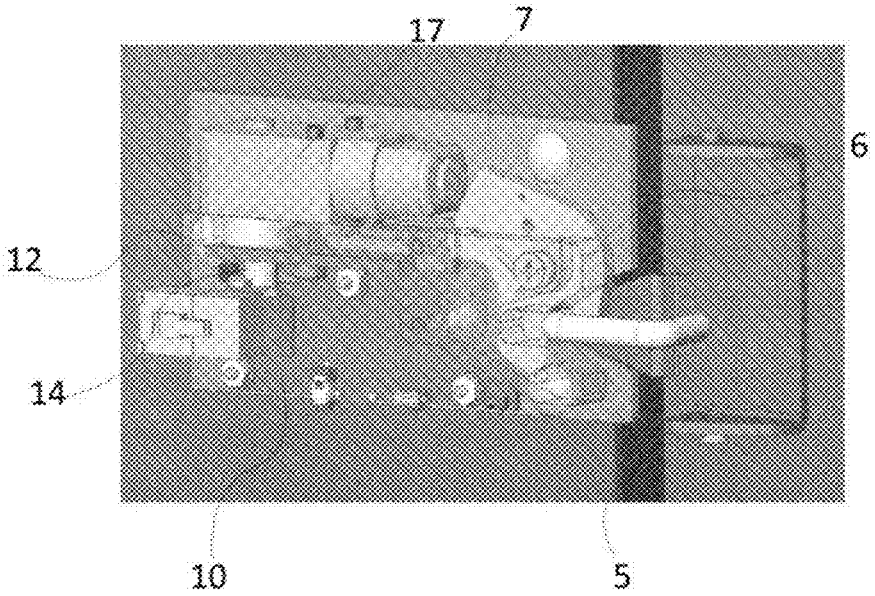
FIG. 12 is a further simplified interior view of the cooler locking structure of FIG. 2 in accordance with an aspect of the disclosure.

Once the slider 12 moves to the far right extended position behind the rear surface of the claw 7, the claw 7 will no longer be able to rotate counter-clockwise as the door is attempted to be opened as shown in FIG. 11; the rear surface of the claw 7 is blocked from rotating counterclockwise by the right extended edge of the slider 12. Thus, the claw 7 and extended slider 12 will serve to hold the strike in the position in FIG. 11 to keep the door closed or locked. Once the electronics determine the door should be unlocked, the motor 17 rotates and moves the cam 14 so that it applies a force to the slider 12 to make it retract, such, that the slider 12 will no longer be in a position to hold the claw 7 in the full clockwise position as in FIG. 9. The claw will then be free to rotate counterclockwise as the door is pulled opened as in FIG. 8.

The manual release 11 serves to manually force the slider 12 from the rightward position to the leftward retracted position to release the slider interference from the claw 7, and allowing the door to be opened. The feature is useful in the event that a person, for example a child, climbs into the cooler and the cooler door closes and locks. A person inside the cooler can push the manual release 11, serving to apply a force to the inclined surface of the slider 12 so the slider 12 retracts by overcoming the force of the slider spring 13 and retracting to the left to release the lock. As an alternative to the push-rod method, a cable can be attached to, for example, the left end position of the slider 12 to pull the slider 12 to the retracted position to release the claw 7 and unlock the unit.

Figure 13:
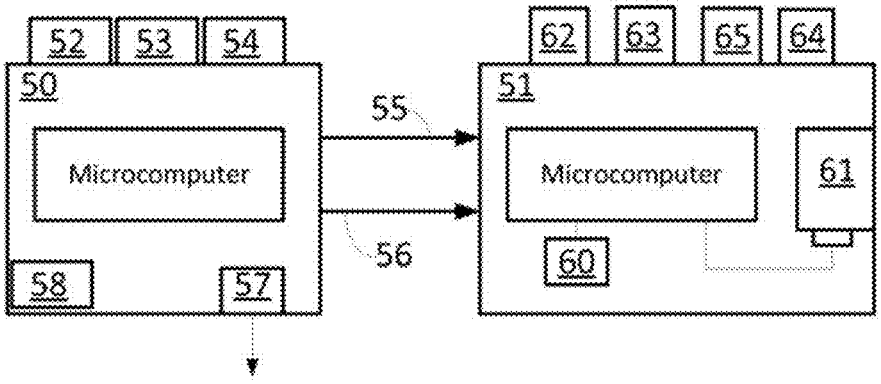
FIG. 13 is a simplified circuit diagram in accordance with an aspect of the disclosure.

In this embodiment, the cooler controller 10 comprises sensors and inputs for measuring a temperature of the enclosure 1 it is locking and unlocking; see FIG. 13. In one example, the cooler controller will control the actuator of an electronic lock mechanism based on the temperature of the enclosure. The cooler 1 has a refrigerator for maintaining products at a temperature around or below 42.degree. F. As long as the temperature is maintained below the desired temperature of 42.degree. F., the cooler can be opened by any patron who desires to open the door, so that the patron can select a product to be purchased.

When the door is closed, the strike mounted on the door is engaged with the latch mounted to the cabinet (or vice versa in an alternative embodiment). If the temperature is proper, for example 42.degree. F, or less, and when the door is pulled open, the latch mechanism allows the strike to be released and the door will swing open. The temperature of the cooler can be communicated remotely over a local or wide-area network.

In the event that the temperature of the cooler exceeds a pre-determined limit for a period of time such as 45 minutes, there is a risk of spoilage of the food or beverage in the cooler. Thus, in an embodiment, when this occurs, the cooler controller proceeds to enable the lock controller and in turn the lock controller energizes the motor and latches the strike so that the door is locked and cannot be withdrawn from the cabinet. The locking event can be communicated remotely over a local or wide-area network. If the temperature returns to a safe/proper temperature, it may be possible for the controller to determine the contents are safe to consume because the cooler temperature only stayed in the elevated range for a short period of time, i.e. too short for the food to spoil. In such a case, the controller may unlock the door.

In another example, the status of the sensors is communicated to a person remote to the cooler over a local or wide-area network, and this person may send a remote signal or command the controller to unlock the controller. As an alternative, the lock controller can also provide a local interface to an electronic or mechanical key or a keypad to signal the controller to unlock the door as shown in FIG. 13.

The latch provides a sensor for detecting the strike releasing from the latch and thus the door swinging open. This door opening sensor can be useful by the controller for measuring the time the door remains open, and alerting someone either locally or remotely (and/or storing this data remote to the cooler) that the door is open for too long to avoid spoilage of food or other items in the cooler.

The latch also comprises a sensor for detecting the locked/unlocked position of the latch. As the motor controls the latch to change states from locked to unlocked, or from unlocked to locked, the sensor will detect the change of state so the lock controller can properly control the state of the latch and report the state of the latch to a device external to the cooler.

The controllers may be powered by AC line voltage and by a battery as a back-up for example. The advantage of the combination of both the AC power and the battery is that the lock controller will be powered primarily from the AC power while it is assumed the cooler will also have the same AC power for operating the refrigerator. Thus the refrigerator should normally be successful keeping the temperature at or below 42.degree. F. If and when, the AC voltage is lost for an extended time period, it is expected the temperature in the cooler will increase to a temperature and for a time period that could cause the food and/or beverages to spoil. In the event of lost power, the controller has the capability, in an embodiment, to control the lock actuator to lock the door, or to latch the strike so the door cannot be withdrawn.

During the time that AC power is lost, the controller may be configured to continue to monitor all the sensors, such as for example, the temperature sensor, and also to measure elapsed time. Thus by conducting these measurements during a power outage, the controller(s) can determine if the temperature has exceeded certain undesirable levels for an extended period of time, in order to determine, if the cooler can be unlocked to allow products to be distributed once the AC power resumes. In addition, the controllers can communicate status of the power and the sensor measurements during the power outage event.

In the event of a temperature limit event the controllers may also serve to control alternative devices related to the cooler, such as the lighting for the cooler. For example, if the temperature limit is exceeded, the controller may be configured to tarn off the lights of the cooler, to discourage patrons from trying to access the cooler (a cooler without lights would visually indicate the cooler has a malfunction).

Another feature of the cooler lock is to lock the door based on a timer or a schedule regardless of cooler temperature. For example, if the cooler is in an office that is typically closed alter 6 PM, the cooler may be automatically locked after 6 PM to discourage maintenance or cleaning crews from taking items from the cooler. If the office re-opens at 8 AM, the cooler would unlock at approximately that time.

In another example, the cooler lock can be in a default locked state. In this embodiment, the patrons can select which products they intend to purchase before opening the cooler door and removing the products. After the products are selected and payment is collected or authorized by credit or debit card, the cooler door can be unlocked for either a) a short period of time, or b) a single access event so the customer can remove the purchased products. In this example, in the event the cooler temperature exceeds certain limits or power is lost as described above, the cooler would remain locked and the customers would be discouraged from paving for products.

Figure 14:
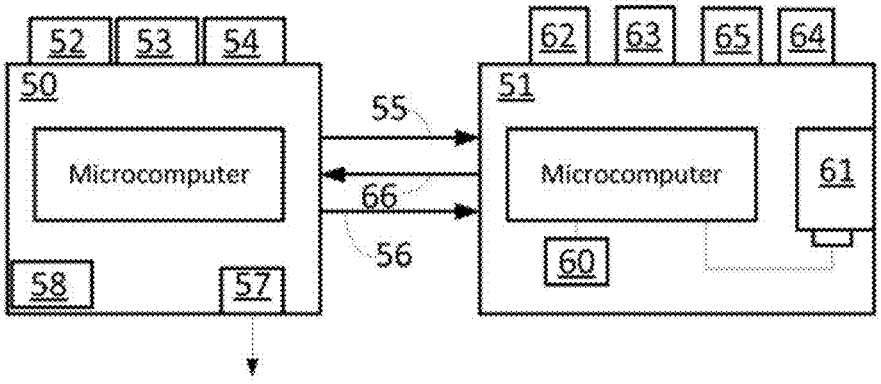
FIG. 14 is a simplified circuit diagram in accordance with an alternative aspect of the disclosure.

In another embodiment, the access control system further includes additional features for providing locking and access to a refrigerated cooler as in FIG. 1A. As shown in FIG. 14, while the cooler door is open the slider can move from the unlocked position shown initially in FIG. 8 to the locked position shown in FIG. 14. In FIG. 8, the cooler door is open, the claw is rotated counter clockwise, and the slider is in the unlocked position and retracted from touching the claw. In the event the door is unlocked and a customer opens the door to select a product, it is possible the controller could send a locked signal to the lock. This situation could take place if, for example, the door is left open for too long of a period of time. In this situation, it is desirable to move the slider to the extended locked position while the claw is rotated counter clockwise and to rest on the curved surface of the claw before the door is closed and before the claw is rotated clockwise.

Once the door is closed and then after the strike rotates the claw clockwise, the slider will continue to move to the extended position and block the movement of the claw, and will maintain the claw in the locked counterclockwise position as shown in FIG. 11. This feature provides for locking the cooler door upon closing the cooler door if a lock event is triggered while the cooler door is open. In another embodiment, if the cooler door is open and a lock event is triggered by a failed probe or an over temperature event, the lock delays the locking event until the cooler door is properly shut. This is accomplished by monitoring the door position, and if the door is open during the lock trigger event the lock, delaying going to the locked condition; later upon sensing the cooler door is closed, the lock then moves to the locked position and the door is locked.

In the embodiment, the lock controller can provide a reset signal to the cooler controller as described below. The reset signal source can come from another source, for example from a separate switch in a secured location (not shown) that is only reached via authorized access. In the event the cooler controller senses a cooler fault and sends the lock signal to the lock controller, and the lock controller locks the cooler door, the service technician must provide a system for repairing the equipment and resetting the lock and cooler controller. Once the lock controller has locked the cooler door, the lock controller is configured to sense a secured signal to indicate the cooler has been repaired and should be reset back to the unlocked condition. In this embodiment, the lock controller will sense a signal via, the keypad or the key sensor, and when this signal is received the lock controller will unlock the cooler door and send a reset signal to the cooler controller, and the cooler controller will release lock signal to the lock controller. In another embodiment, the lock or cooler controller will sense a reset signal from a mechanical switch accessible by a mechanical or electronic lock.

Upon either a power-up condition or upon receiving a reset signal from the lock controller, the cooler controller will wait for the cooler to begin cooling and the temperature to reach a low temperature, for example 37.degree. F. before proceeding to the lock control measurement algorithm. Prior to reaching the lower temperature, e.g., 37.degree. F., the cooler controller will continue to output the unlock signal. Once a temperature of 37.degree. F. or below is attained, the cooler controller begins the lock control algorithm and continues to output the unlock signal since the temperature is proper. Once the cooler controller measures a higher than normal temperature for a certain time period (over-temperature time), for example 42.degree. F. for 15 minutes, the cooler controller will send the lock controller the lock signal.

The cooler or lock controller may be powered by a battery and may be programmed to lock the cooler door alter loss of AC power, regardless if the temperature has exceeded the temperature limit of 42.degree. F. This will insure the cooler door will be locked before the back-up battery has depleted, and it would be too late to lock the cooler door.

In an embodiment a service mode of operation is provided, whereby the cooler and lock controllers are placed into an operation mode that will not provide for the cooler door to be locked for a period of time typically longer than the over-temperature trigger time (for example ½ hour), so that the cooler can stand open and be loaded with products. After the service mode time period, the cooler controller resumes monitoring for a temperature default. It is desirable to exit the service mode after one single service mode time period, and to restrict consecutive service mode time periods.

As an alternative to a manually-entered service mode, in an embodiment, the cooler controller intelligently controls the service mode of the cooler by measuring the temperature rate of change. For example, if the temperature of the cooler rises above 42 degrees this could be due to either a fault of the cooler, or due to the cooler being refilled or serviced. After being filled or serviced, the door is closed and the temperature should begin to decrease rapidly toward the proper level provided the cooler is functioning properly. In this embodiment, when the cooler temperature exceeds the over-temperature trigger time while it is in the process of rapidly cooling down, the controller logic refrains from locking the cooler because as the controller measures the rapid rate of temperature change it can determine that a service condition is in process and determine to not lock the door, since it has determined that the temperature variation is not a faulty cooler refrigeration condition.

The cooler controller may also sense for a foiled temperature probe in an embodiment, and may communicate a cooler lock event with the lock controller. The time period that the cooler controller senses for the failed probe before the lock signal is communicated from the cooler controller to the lock controller is typically shorter than the over-temperature delay time as described above. It is desirable to quickly lock the door in the event of a temperature probe fault because the integrity of the entire cooler system is in question, and the risk of serving spoiled food is minimized by locking the door. The cooler locking system may also include a test switch (not shown, typically mounted in a location that is easily accessible without the use of tools) that will be used by an equipment technician or health inspector to simulate an over-temperature condition or a failed probe condition to determine if the lock if functioning properly. In a working system, when the test switch is activated, the controller will sense (erroneously) that there is a malfunction of the cooler or the probe and will send a lock signal to the lock, and the cooler will proceed to lock. The system will return to normal operation after the switch is deactivated, or if the system receives another signal, such as an access signal from the key or a reset signal.

Figure 15:
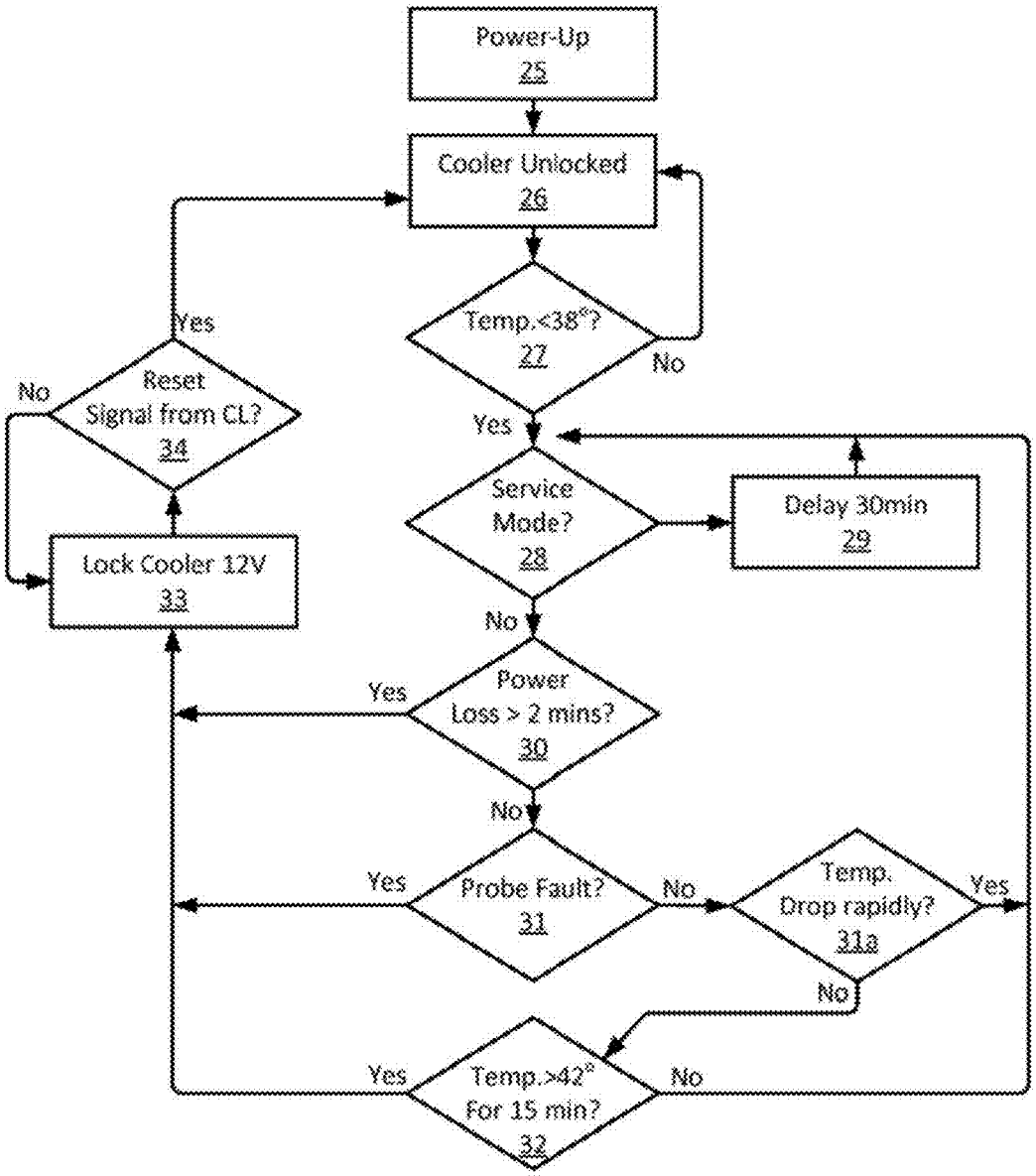
FIG. 15 is a process flow chart illustrating a process executed by a cooler controller in an embodiment.
Figure 16:
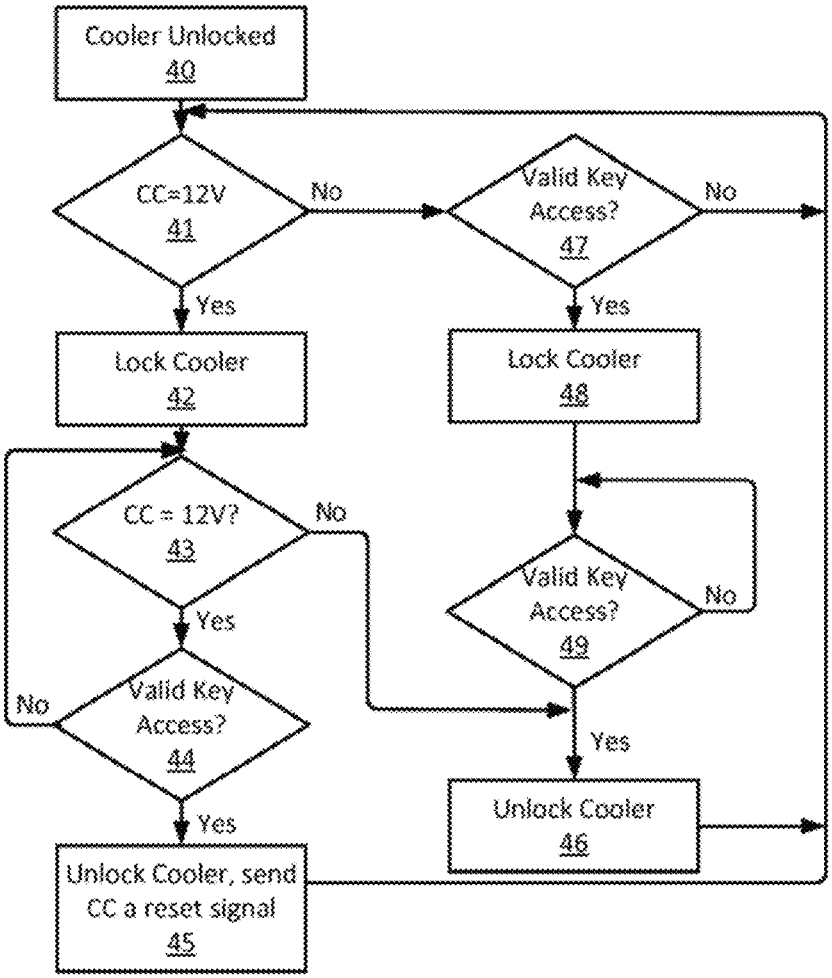
FIG. 16 is a process flow chart illustrating a process executed by a lock controller its an embodiment.

FIGS. 15 and 16 describe an example of the control logic of the cooler controller (CC) and the cooler lock (CL) in greater detail. Referring to FIG. 15 first the cooler controller process begins at stage 25, wherein the system powers up. Subsequently at stage 26, the cooler is unlocked, e.g., the cooler controller outputs a 0V signal to the lock. The cooler controller then determines at stage 27 whether the internal temperature of the cooler is at or below a threshold value such as 38.degree. F. If the temperature is determined to be at or below the threshold value, the process continues to stage 28, wherein the cooler controller determines if the system is in service mode as described above. In the event that the system is in service mode, the process flows to stage 29, wherein a 30 minute delay, or other suitable delay period, is imposed and the process flows back into stage 28.

If instead it was determined that the system is not in service mode, the process flows to stage 30, wherein the cooler controller determines whether there has been a power loss exceeding sortie time threshold, such as 2 minutes. If so, the process flows to stage 31, wherein the cooler controller determines whether there is a probe fault, and if there is not, the process continues to stage 31*a*. At stage 31*a*, if the measured temperature is decreasing at a rapid rate, it is assumed the cooler is working properly and it may have been recently opened for service or re-filling, and thus it should remain unlocked and should not proceed to stage 32. If the temperature is not decreasing at a rapid rate, the process flows to stage 32. At stage 32, the cooler-controller determines whether the internal temperature has been above a second threshold temperature, e.g., 42.degree. F., for greater than a predetermined period, e.g., 1.5 minutes.

In the event that the temperature has not been above the second threshold temperature for greater than the predetermined period, the process flows hack to stage 28. Otherwise, the process flows to stage 33, wherein the cooler controller locks the cooler, e.g., by sending a 12V signal to the lock motor. From stage 33, the cooler controller determines at stage 34 whether a reset signal has been received, and if such a signal has been received, the process returns to stage 26. Otherwise, the process flows back to stage 33.

Returning to the decision stages 30 and 31, if either of these stages results in an affirmative determination (yes, probe limited and/or yes power lost for greater than the prescribed period), then the process flows immediately to stage 33. From there, the process continues as described above.

Turning to FIG. 16, this figure shows the control process from the standpoint of the cooler lock controller. Starting at stage 40, the cooler is unlocked. Next at stage 41, it is determined whether a 12v (lock) signal is received from the cooler controller. If so, the cooler lock locks at stage 42. Subsequently at stage 43, the lock controller determines whether CC is set, whether it reads 12V. If so, the controller checks for a valid key access at stage 44. If a valid key access is detected at stage 44, the process continues to stage 45, wherein the lock controller unlocks the cooler and sends a cooler controller reset signal.

If at stage 43 it is determined that CIF is not set, then the process flows to stage 46 to unlock the cooler and then returns to stage 41. If at stage 44 it is determined that there is no valid key access, then the process returns to stage 43.

If at stage 41 it determined that a 12v (lock) signal is not received from the cooler controller, the process looks for a valid key access at stage 47, and if such access is not found, proceeds back to stage 41. Otherwise, the process flows to stage 48, and the cooler is locked. Subsequently at stage 49, is again determined whether a valid key access has occurred. If so, the process moves on to stage 46 and continues thence as described above. If, however, no valid key access is found, the process loops at stage 49.

As noted above, FIG. 13 is a simplified schematic of a control system usable to implement the processes described herein. The illustrated system includes primarily a cooler controller 50 and a lock controller 51. Both controllers may be, for example, microcomputer or microprocessor-based controllers. In an alternative embodiment, the two microcomputers may be integrated together into a single microcomputer controller.

The cooler controller 50 includes inputs for power 52 and a temperature probe 53. The cooler controller 50 also includes outputs, e.g., for light control 54, lock control 55, lock controller power 56, as well as an Ethernet or other data connection 57 to access a LAN or a WAN, such as the internet. The cooler controller 50 may also include a battery 58 for back-up purposes.

The lock controller 51 includes a clock 60 and a lock actuator 61. The lock controller 51 also includes inputs for a key sensor 62, a keypad 63, a door sensor 64, and a latch position sensor 65, in an embodiment wherein a reset capability is included, the system also includes a reset line 66 providing input from the lock controller 51 to the cooler controller 50, as shown in FIG. 14.

In another embodiment illustrate in FIGS. 17-24, a lock with components similar to the lock of previous embodiments is employed to lock a refrigerator or freezer with two or more doors.

Figure 17:
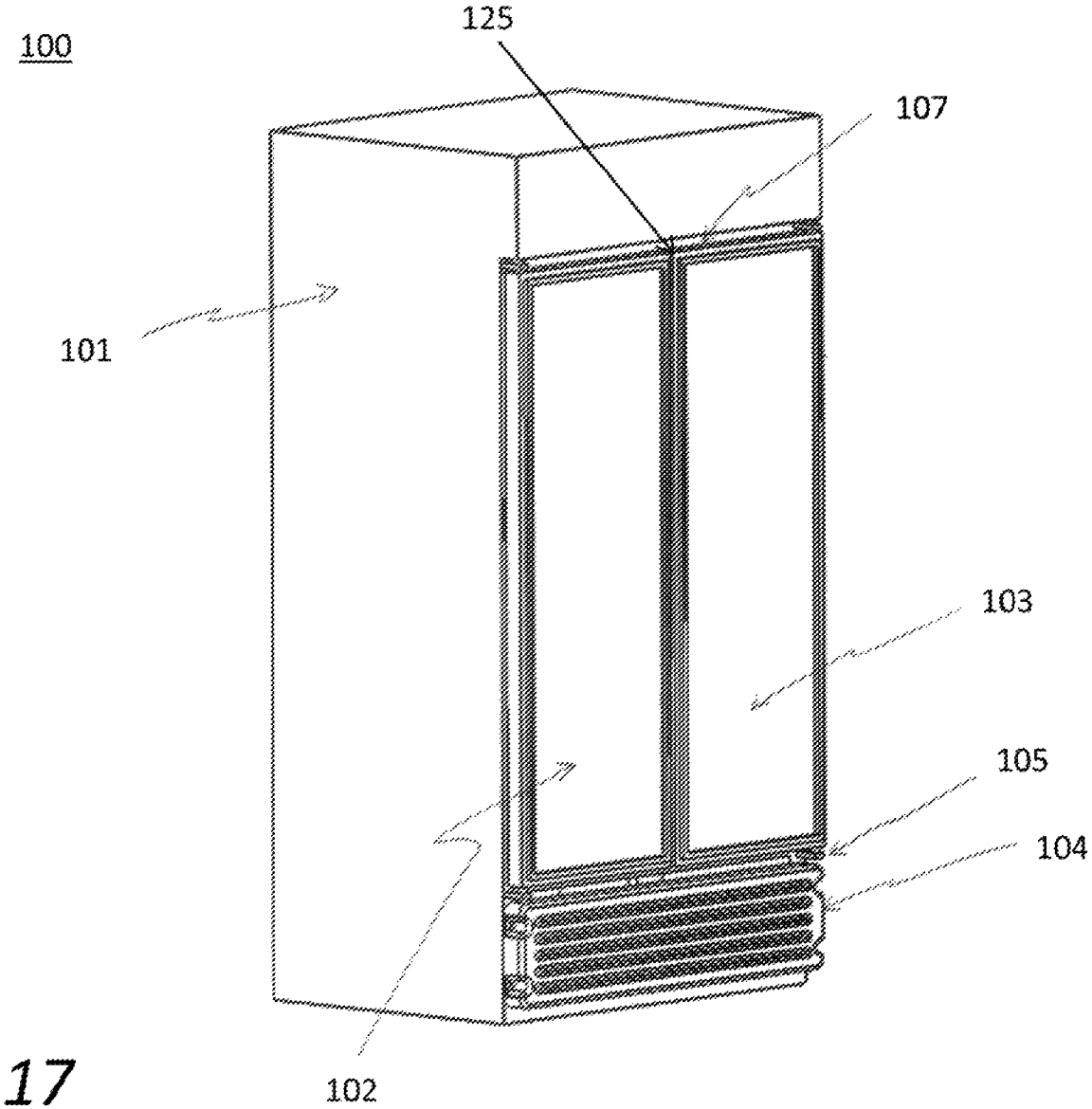
FIG. 17 is a simplified perspective view of a closed, double door cooler structure within which aspects of the disclosure may be implemented.
Figure 18:
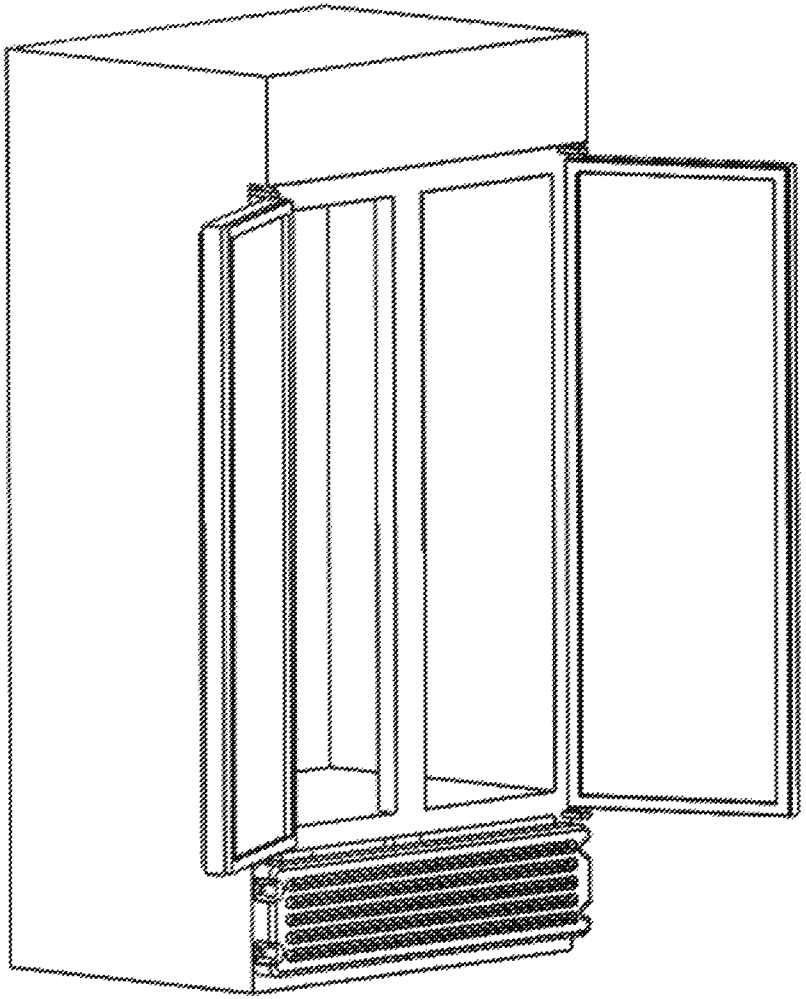
FIG. 18 is a simplified perspective view of an opened, double door cooler structure within which aspects of the disclosure of FIG. 17 may be implemented.

FIG. 17 shows a refrigerator unit 100 with a cabinet 101, a first door 102, a second door 103, a grill 104, a gap 105 between the grill 104 and doors 102 & 103, and a gap 107 between doors 102 & 103 and cabinet 101. Doors 102 & 103 are swinging doors as shown in FIG. 18, having a gap 125 there between, but a lock can also be used for a unit with sliding doors as discussed above.

Figure 20:
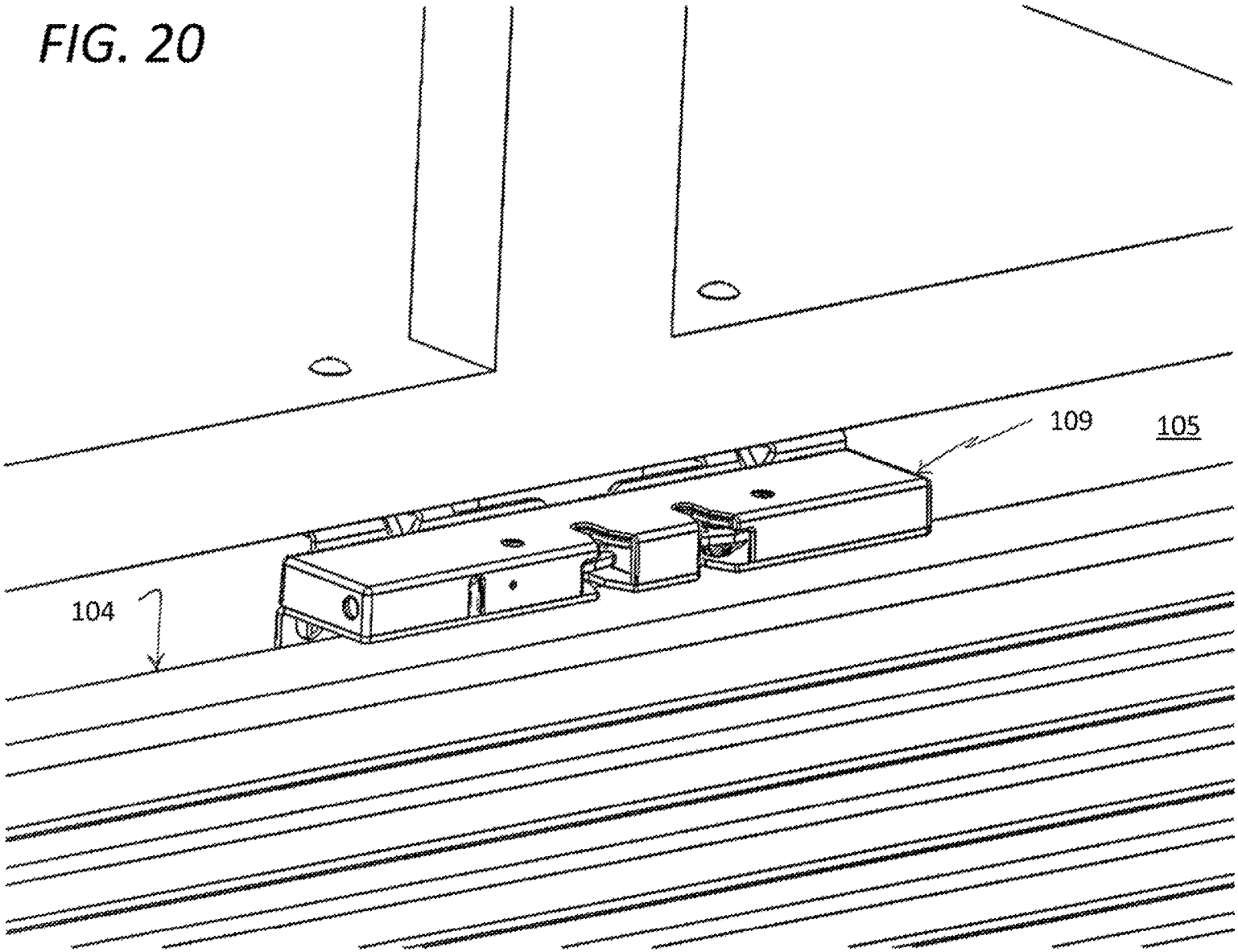
FIG. 20 is a simplified exterior view of the cooler locking mechanism in accordance with an aspect of the disclosure of FIG. 17.

FIG. 20 shows lock 109 mounted to cabinet 101 of unit 100 inside gap 105. Lock 109 can also be mounted in gap 107 as an alternative position. Further, in an alternative embodiment the lock can also be mounted on a vertical plane in the gap 125 between the two doors.

Figure 19:
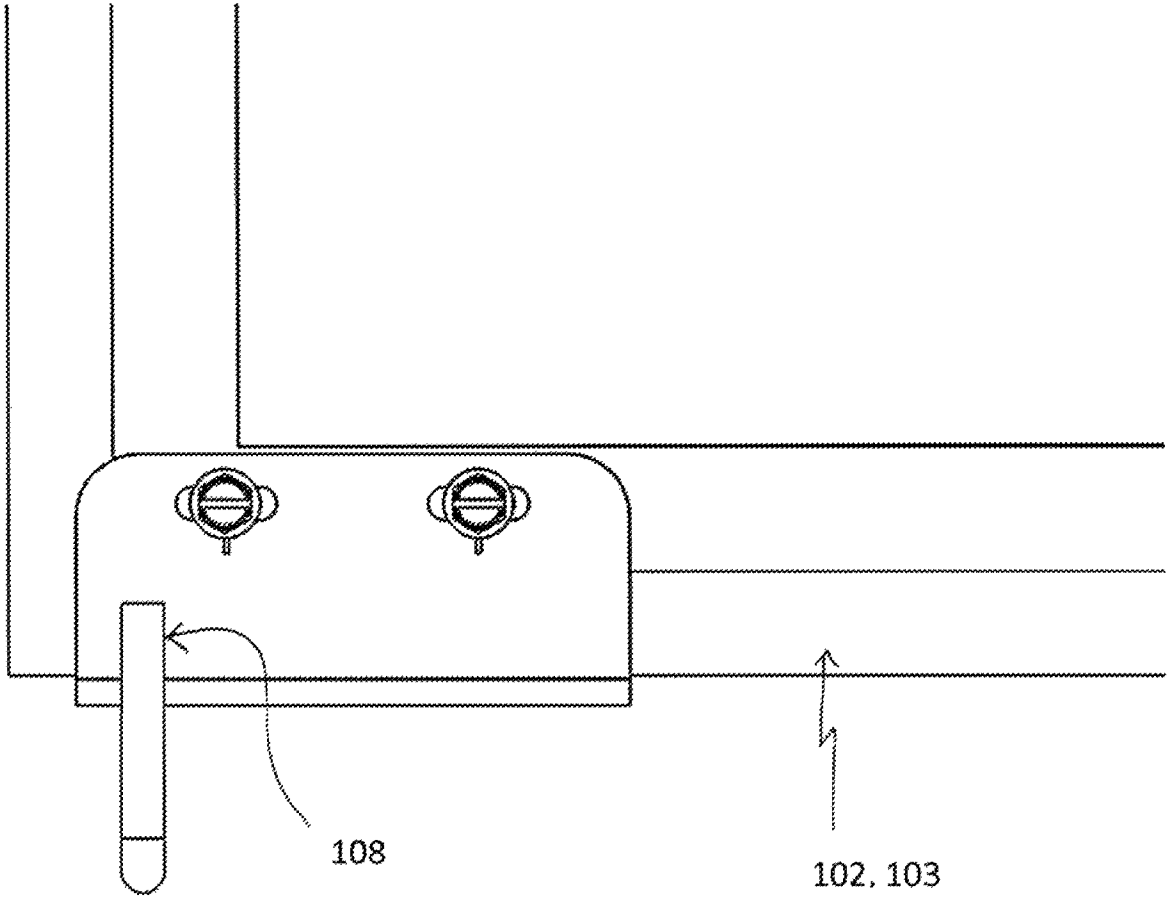
FIG. 19 is a simplified exterior view of one of the cooler locking elements in accordance with an aspect of the disclosure of FIG. 17.

FIG. 19 shows door strike 108 attached to one of the doors 102 or 103. The other of the doors 102 or 103 will likewise have its own door strike 108. When the doors are closed, the respective strikes 108 will engage with lock 109 as shown in FIG. 22.

Figure 21:
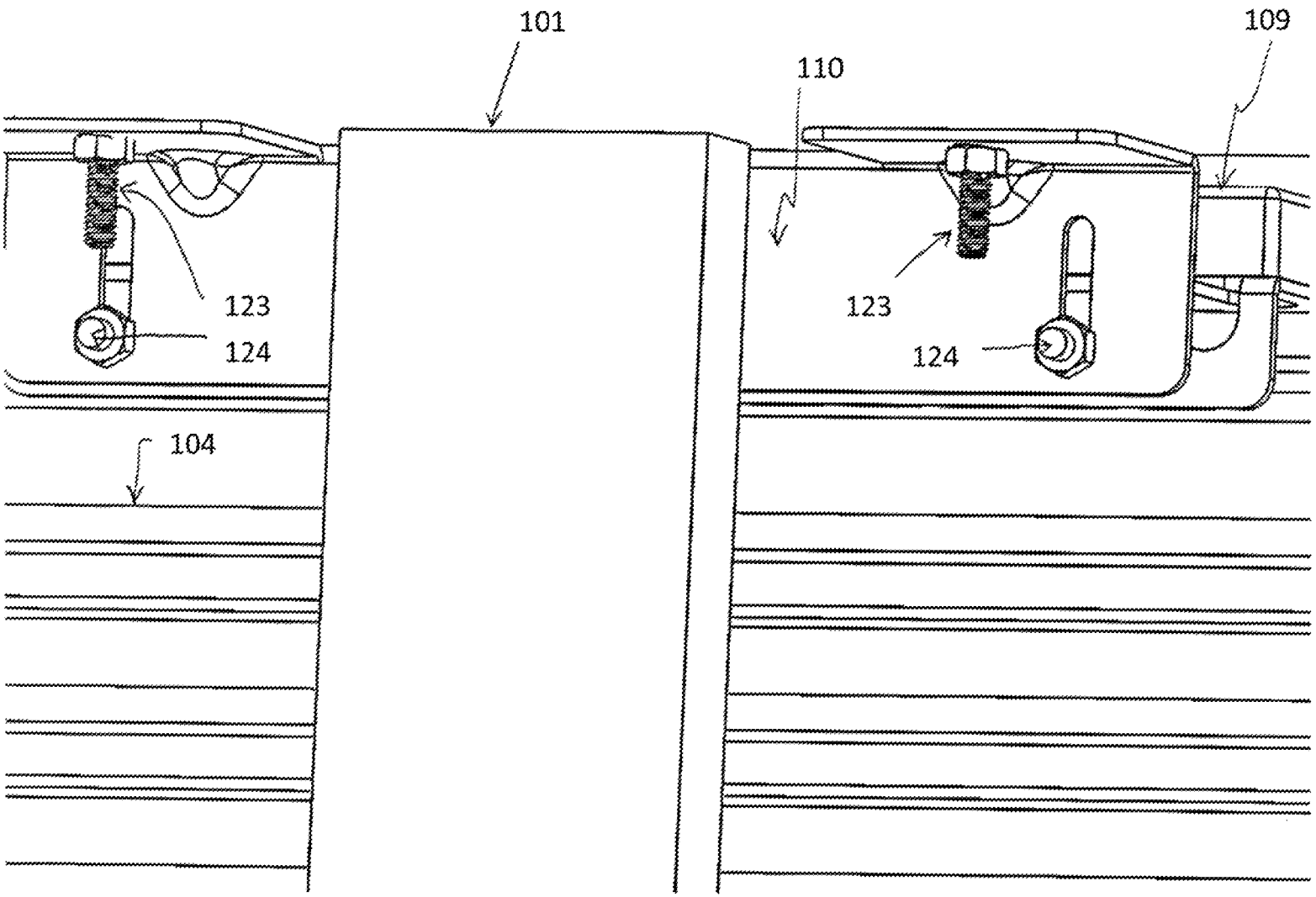
FIG. 21 is a simplified interior view of the rear mounting attachment of the cooler locking mechanism in accordance with an aspect of the disclosure of FIG. 17.

FIG. 21 shows the rear mounting attachment of the lock. Plate 110 is attached to cabinet 101 via holts 123. Lock 109 is mounted to plate 110 via bolts 124.

Figure 22:
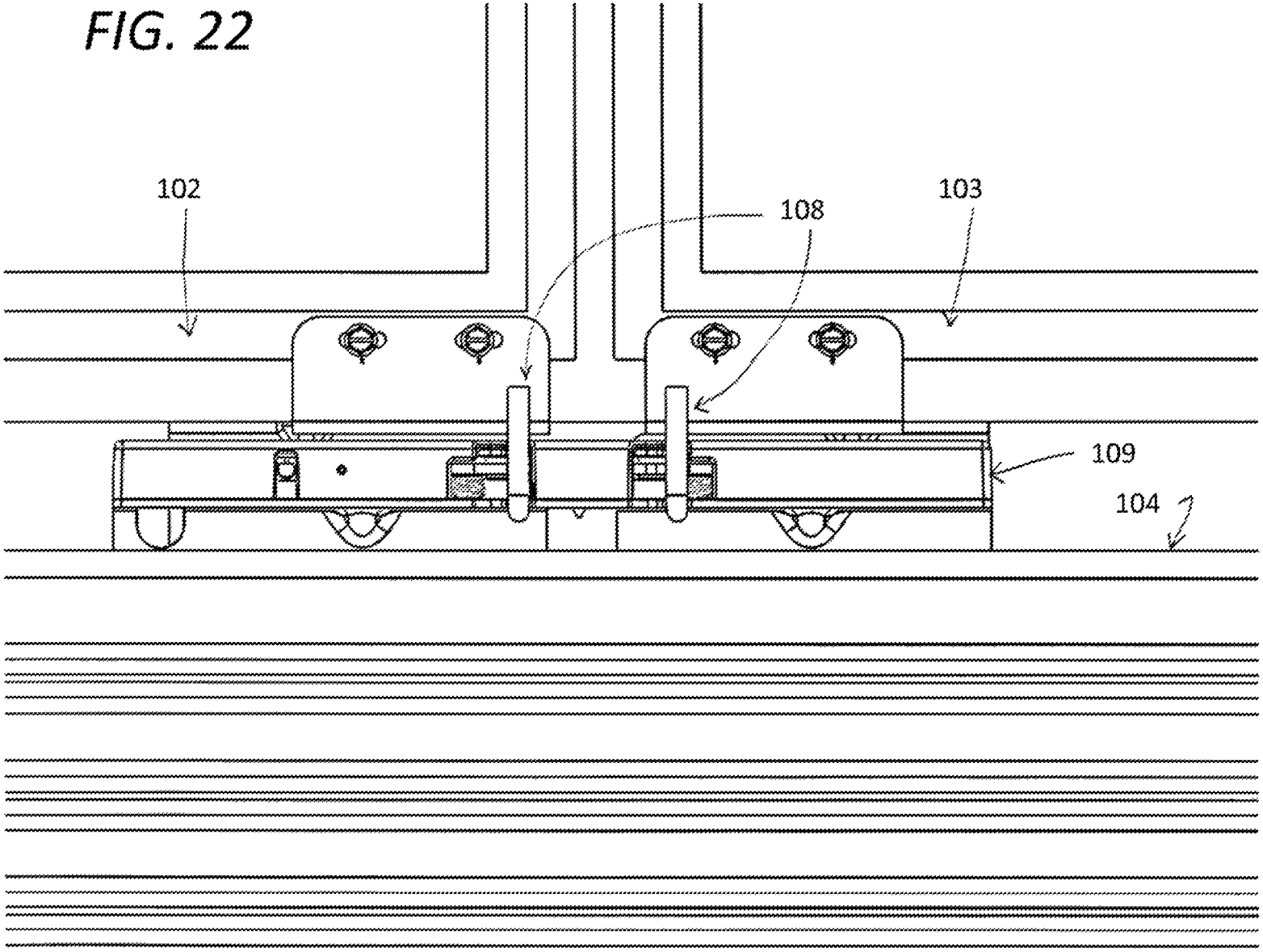
FIG. 22 is a simplified exterior view of the cooler locking structure in accordance with an aspect of the disclosure of FIG. 17.

FIG. 22 shows the front view of the lock mounted to the unit, with strikes 108 engaged with lock 109 when the doors 102 and 103 are closed.

Figure 23:
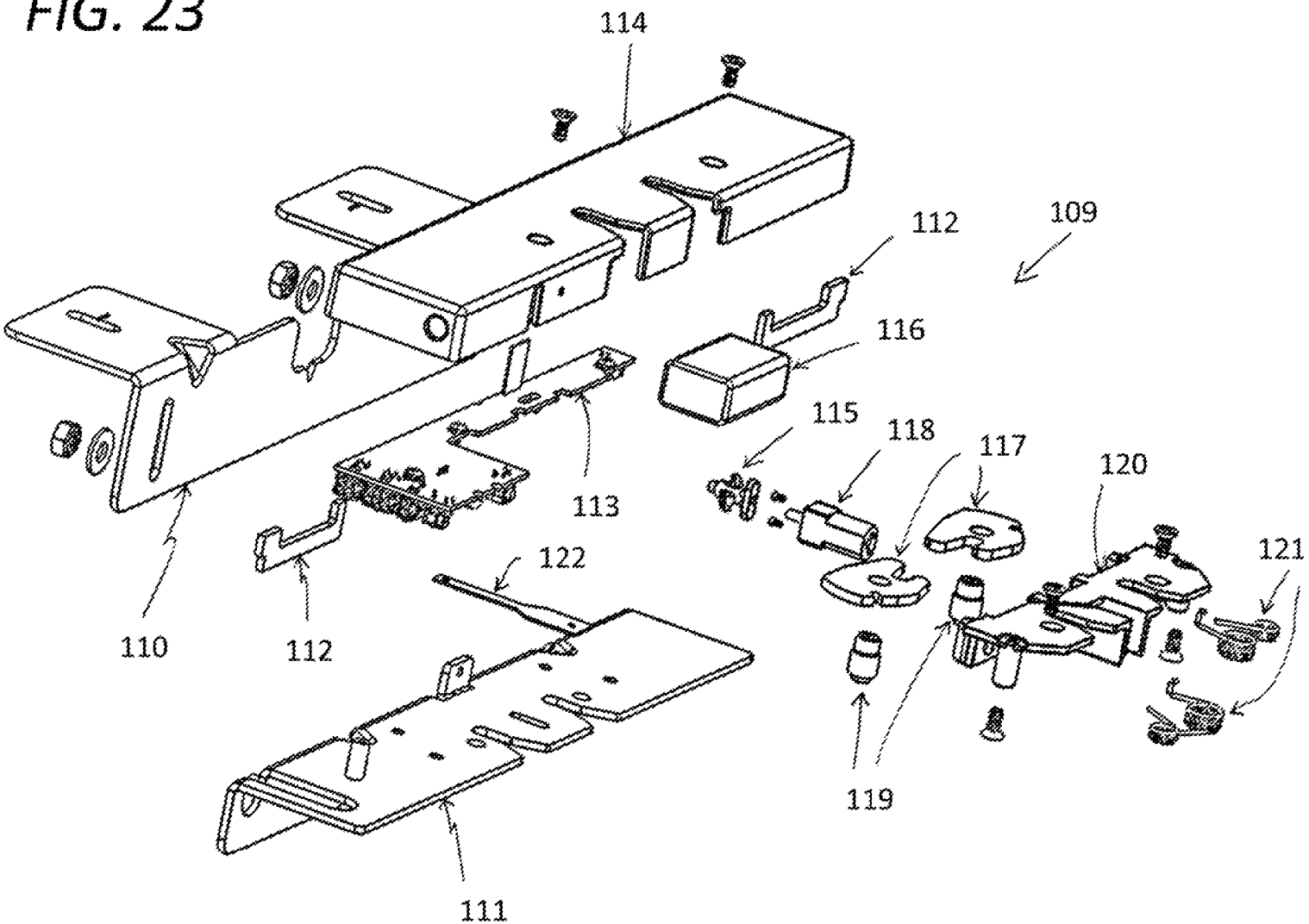
FIG. 23 is a simplified exploded front perspective view of the cooler locking mechanism of FIG. 20 in accordance with an aspect of the disclosure.
Figure 24:
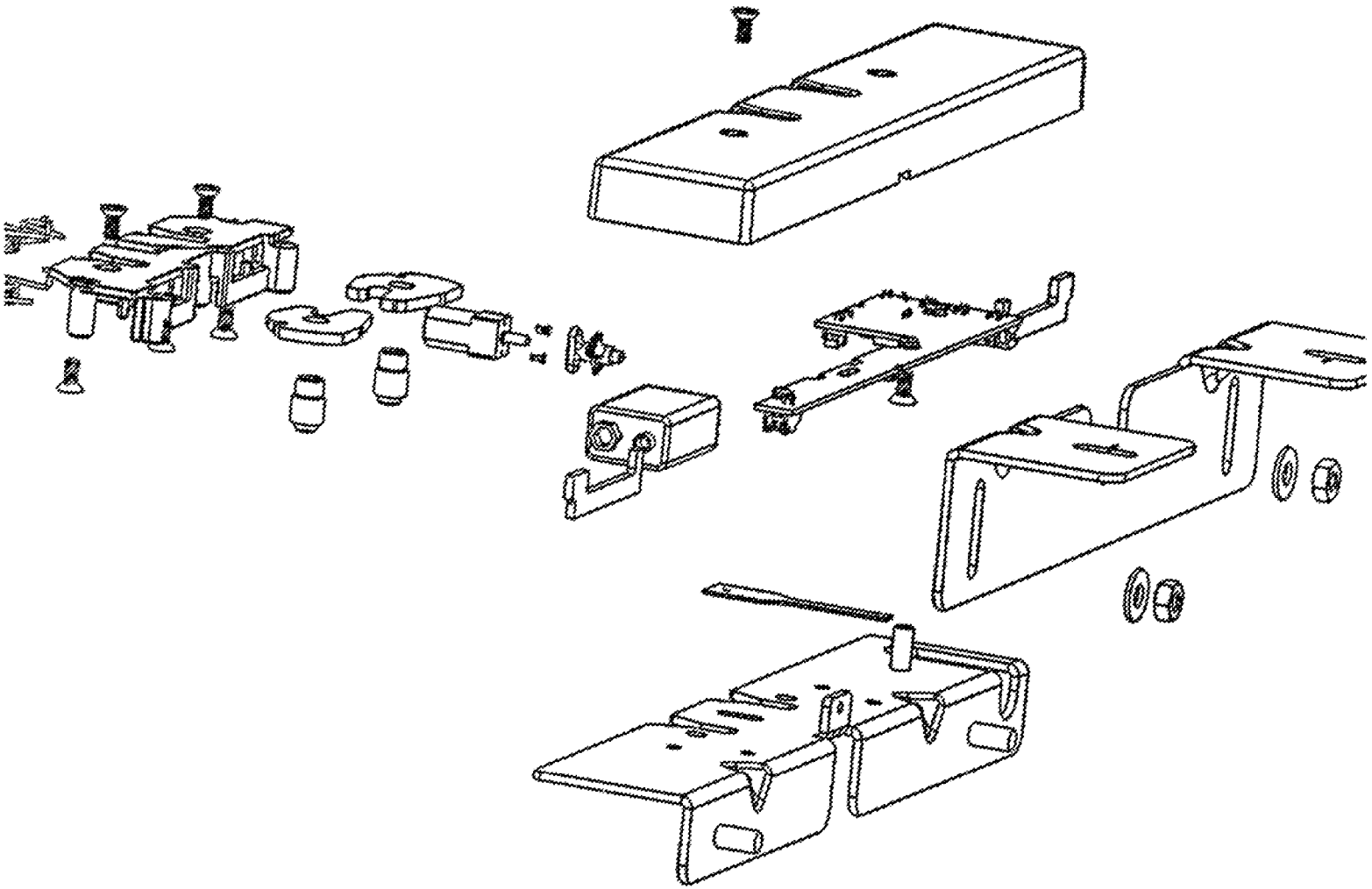
FIG. 24 is a simplified exploded rear perspective view of the cooler locking mechanism of FIG. 20 in accordance with an aspect of the disclosure.

FIGS. 23 and 24 show the exploded internal details of lock 109 and also show plate 110. Lock 109 consists of plate 111, sliders 112, circuit board 113, cover 114, cam 115, battery 116, claws 117, motor 118, bearings 119, cam mounts 120, springs 121, and release lever 122. The construction and operation of lock 109 is similar to lock 2 in the previous figures. The primary difference is that the motor 118, sliders 112 and cam 115 are controlling the locking and unlocking of the two claws 117 instead of one, and the claws 117 are mounted and operate in a plane perpendicular to the plane of the doors instead of in a plane parallel to the plane of the doors.

The primary functional difference and advantage lock 109 has is the slender construction and the ability of the claws to operate in a horizontal or first plane, perpendicular to the plane of the door, operate in a position either above or below doors 102 and 103 in gaps 105 or 107, and to engage with the door strikes mounted in a vertical or second plane, parallel, to the plane of the door. In many applications there is very little room at the edge of the refrigerator door or cabinet to mount an external lock as shown in FIG. 1A. The lock 109 operation will facilitate mounting of lock 109 either inside gap 105 below the doors and above the grill, or above the doors in gap 107. Alternately, if the lock is mounted in the gap 125 between the doors, the claws will operate in a vertical plane, perpendicular to the plane of the door, and engage the door strikes mounted in a horizontal plane, parallel to the plane of the door.

It should be understood that this double door lock embodiment having a slender construction can be equally applicable to a single door and comprise a single door lock of slender construction mounted in one of the gaps, but only having one claw operable in a first plane, perpendicular to the plane of the door, and engaging with a single door strike mounted in a second plane, parallel to the plane of the door. Further, a strike on one door could engage a strike on the other door so that a single lock can lock both doors simultaneously.

The slender construction of the locks of this embodiment preferably have a height or thickness of no more than one inch, and can be as slender as 0.40 inches. In a preferred embodiment, the lock for either a double door or a single door has a height or thickness of 0.75 inches. The gap that is available above and below the cooler door or between the doors is typically 0.50 inches to 1.0 inch depending on the cooler. If the gap is less than one inch, a preferred method is to remove the grill and mount the lock below the door, and then lower the mounting or re-mounting of the grill after mounting the lock. Alternatively, a suitable sized notch can be cut out of the grill to accommodate or make room for the lock, and the grill can be remounted in its original location.

It will be appreciated that a new and useful system for cooler lock function and control has been disclosed and described herein. However, while the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure are broader than the embodiments specifically disclosed and are encompassed within the claims appended hereto.

While certain features are described in conjunction with specific embodiments of the invention, these features are not limited to use with only the embodiment with which they are described, but instead may be used together with or separate from, other features disclosed in conjunction with alternate embodiments of the invention.

What is claimed is:

1. A locking system for a refrigerated cooler or freezer having a first door and a second door, the locking system comprising:
   - a refrigerated cooler or freezer having a first door and a second door;
   - a first latch adapted to selectively engage a first door strike on the first door; and
   - a second latch adapted to selectively engage a second door strike on the second door;
   - wherein the first latch and the second latch are positioned in a first plane perpendicular to a plane of the first door and the second door, and wherein the first door strike and the second door strike are positioned in a second plane parallel to the plane of the first door and the second door, and wherein the first latch and the second latch are in an unlocked state when a temperature of the refrigerated cooler or freezer is at or below a temperature of 42 degrees F.;
   - a lock controller for selectively placing the first latch and the second latch in a locked state, wherein the lock controller is configured to permit public access to the refrigerated cooler or freezer when a temperature of refrigerated air in the refrigerated cooler or freezer is at or below a temperature of 42 degrees F.; and
   - a cooler or freezer controller configured to detect a fault event indicative of a fault in the operation of the refrigerated cooler or freezer resulting in a change in a temperature of the refrigerated cooler or freezer that requires locking the refrigerated cooler or freezer and, in response, to signal the lock controller to lock the first door and the second door to the refrigerated cooler or freezer by placing the first latch and the second latch in a locked state after the temperature of the refrigerated air in the refrigerated cooler or freezer has exceeded 42 degrees F. for a time period of one or more minutes.

2. The lock of claim 1, wherein the first plane and the second plane are perpendicular.

3. The lock of claim 1, wherein the lock is positioned below the first door and the second door.

4. The lock of claim 1, wherein the lock is positioned above the first door and the second door.

5. The lock of claim 1, wherein the lock is positioned between the first door and the second door.

6. The lock of claim 1, further comprises a motorized cam adapted to selectively provide movement to a first slider and a second slider, wherein the first slider is adapted to selectively engage and prevent movement of the first latch, and the second slider is adapted to selectively engage and prevent movement of the second latch.

7. A locking system for a refrigerated cooler or freezer, comprising:
   - a refrigerated enclosure having a first sidewall, a second sidewall, a top, a bottom, a back wall, and a front opening divided along a center line into a first access opening and a second access opening;
   - a first door having a hinged edge proximate the first sidewall and a free edge proximate the center line, the first door selectively enclosing the first access opening when in a closed position;
   - a second door having a hinged edge proximate the second sidewall and a free edge proximate the center line, the second door selectively enclosing the second access opening when in a closed position;
   - a first door strike mounted proximate the free edge of the first door;
   - a second door strike mounted proximate the free edge of the second door;

a lock for selectively and simultaneously locking the first door in its closed position and the second door in its closed position, wherein the lock includes a first latch for engaging the first door strike, and a second latch for engaging the second door strike;

a lock controller for selectively actuating the lock, wherein the lock controller is configured to permit public access to the refrigerated cooler or freezer when a temperature of refrigerated air in the refrigerated cooler or freezer is at or below a temperature of 42 degrees F.; and a cooler or freezer controller configured to detect a fault event indicative of a fault in the operation of the refrigerated cooler or freezer resulting in a change in a temperature of the refrigerated cooler or freezer that requires locking the refrigerated cooler or freezer and, in response, to signal the lock controller to actuate the lock after the temperature of the refrigerated air in the refrigerated cooler or freezer has exceeded 42 degrees F. for a time period of one or more minutes.

8. The locking system of claim 7, wherein the first latch and the second latch are positioned in a first plane perpendicular to a plane of the first door and the second door, and wherein the first door strike and the second door strike are positioned in a second plane parallel to the plane of the first door and the second door.

9. The locking system of claim 8, wherein the first plane and the second plane are perpendicular.

10. The locking system of claim 7, wherein the lock is positioned below the first door and the second door.

11. The locking system of claim 7, wherein the lock is positioned above the first door and the second door.

12. The locking system of claim 7, wherein the lock is positioned between the first door and the second door.

13. The locking system of claim 7, wherein the lock further comprises a motorized cam for selectively providing movement to a first slider and a second slider, wherein the first slider is adapted to selectively engage and prevent movement of the first latch, and the second slider is adapted to selectively engage and prevent movement of the second latch.

14. The locking system of claim 1, wherein the lock controller is further configured to refrain from placing the first latch and the second latch in the locked state when the temperature of refrigerated air in the refrigerated cooler or freezer is rapidly changing at temperatures above 42 degrees F.

15. The locking system of claim 7, wherein the lock controller is further configured to refrain from actuating the lock when the temperature of refrigerated air in the refrigerated cooler or freezer is rapidly changing at temperatures above 42 degrees F.

* * * * *